US005976756A

United States Patent [19]

Nakamura et al.

[11] Patent Number: 5,976,756

[45] **Date of Patent: *Nov. 2, 1999**

[54] COLOR DIFFUSION TRANSFER SILVER HALIDE PHOTOGRAPHIC MATERIALS AND PROCESS FOR FORMING IMAGES

[75] Inventors: Koki Nakamura; Kiyoshi Takeuchi; Taiji Katsumata; Toshiki Taguchi, all of Minami Ashigara, Japan

[73] Assignee: Fuji Photo Film, Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/758,101

[22] Filed: Nov. 29, 1996

[30] Foreign Application Priority Data

Nov. 30, 1995 [JP] Japan ..... 7-334173

[51] Int. Cl.[6] ..... G03C 8/40; G03C 8/20; G03C 7/413

[52] U.S. Cl. ..... 430/203; 430/218; 430/226; 430/380; 430/467; 430/483; 430/484; 430/566

[58] Field of Search ..... 430/218, 226, 430/380, 467, 483, 484, 359, 361, 264, 566, 203

[56] References Cited

U.S. PATENT DOCUMENTS

| | | | |
|---|---|---|---|
| 3,227,552 | 1/1966 | Whitmore | 430/226 |
| 3,782,949 | 1/1974 | Olivates et al. | 430/218 |
| 4,469,773 | 9/1984 | Adin et al. | 430/222 |
| 4,481,268 | 11/1984 | Bailey et al. | 430/380 |
| 4,684,604 | 8/1987 | Harder | 430/223 |
| 4,740,445 | 4/1988 | Hirai et al. | 430/203 |
| 4,847,188 | 7/1989 | Komamura et al. | 430/226 |
| 4,880,723 | 11/1989 | Hatai et al. | 430/203 |
| 4,923,787 | 5/1990 | Harder | 430/264 |
| 4,978,602 | 12/1990 | Fujita et al. | 430/264 |
| 5,147,764 | 9/1992 | Bowne | 430/380 |
| 5,262,274 | 11/1993 | Katoh | 430/264 |
| 5,284,739 | 2/1994 | Clarke et al. | 430/264 |
| 5,547,810 | 8/1996 | Morimoto et al. | 430/203 |
| 5,780,210 | 7/1998 | Takeuchi et al. | 430/435 |

FOREIGN PATENT DOCUMENTS 63-36487 7/1988 Japan .

*Primary Examiner*—Richard L. Schilling
*Attorney, Agent, or Firm*—Birch, Stewart, Kolasch & Birch, LLP

[57] ABSTRACT

A diffusion transfer silver halide photographic material containing a color developing agent represented by the following formula (I) in a hydrophilic colloid layer provided on a support:

(I)

wherein $C_\alpha$ represents a carbon atom; Z represents a carbamoyl group, an acyl group, an alkoxycarbonyl group, or an aryloxycarbonyl group; and Q represents an atomic group for forming a unsaturated ring together with $C_\alpha$, whereby a color diffusion transfer silver halide photographic material containing a novel color developing agent from which a diffusible dye can be formed is provided.

10 Claims, No Drawings

COLOR DIFFUSION TRANSFER SILVER HALIDE PHOTOGRAPHIC MATERIALS AND PROCESS FOR FORMING IMAGES

FIELD OF THE INVENTION

The present invention relates to a technique for forming novel diffusion transfer dyes. More specifically, it relates to an image forming element of a silver halide color diffusion transfer type which contains a novel diffusible dye-formable color developing agent and to a novel process for forming images.

BACKGROUND OF THE INVENTION

In the field of silver halide photographic materials, the so-called color diffusion transfer process in which diffusible dyes are imagewise formed followed by fixing them on an image receiving material is well known, and many proposals have been made for the process. In these processes, diffusible dyes are generally formed upon development of silver halides from compounds enhanced in nondiffusibility which are derived from image forming dyes colored beforehand (preformed dyes) (The compounds enhanced in nondiffusibility are hereinafter referred to as "coloring materials"). In such processes, addition of the coloring materials to silver halide emulsion layers causes undesirable sensitivity decrease to exposure, because of the filter effect due to the dye moieties of the coloring materials. As a means of avoiding this problem, the coloring materials for forming images are therefore added to layers far from the surfaces of the silver halide emulsion layers to be exposed to light in general. Although the sensitivity decrease due to the above-mentioned filter effect can be avoided by this means, long physical distances between the silver halide emulsions and the coloring materials from which diffusible dyes are formed result in nonefficient development information transfer to develop a defect in this process.

To overcome these problems, a so-called coupling system has been proposed, in which image formation is performed by a coupling reaction of couplers with oxidation products of developing agents which are formed as results of the development of silver halides. An advantage of this system is that both the developing agents and the couplers are colorless to overcome the defect in the system utilizing the preformed dyes, and accordingly, the above system is preferable to the coloring materials utilizing the preformed dyes. Examples of this process are described in U.S. Pat. No. 4,469,773, JP-B-63-36487 (The term "JP-B" as used herein means an "examined Japanese patent publication"), etc.

Incorporation of the above-mentioned color developing agents of the coupling system into the photographic materials, however, brings about insufficient compatibility of expected storage stability with activity in the coupling reaction. In this system, both the color developing agents and couplers are desired to be nondiffusive in view of prevention of color amalgamation between silver halide emulsion layers having different spectral sensitivities. In the processes known previously, it has been difficult, however, to form diffusible dyes from the couplers and color developing agents both of which are nondiffusive.

Furthermore, the above-mentioned processes also have the disadvantage of developing undesirable stains with time, because the color developing agents unused on development spread throughout the receiving material owing to large diffusibility thereof.

SUMMARY OF THE INVENTION

A first object of the present invention is to provide a method for forming diffusible dyes from substantially colorless color developing agents and couplers.

A second object of the present invention is to provide a method for forming diffusible dyes at a speed sufficient for development from nondiffusive color developing agents and couplers.

A third object of the present invention is to provide a silver halide color diffusion transfer photographic material which forms color transfer images excellent in image quality by use of these methods and a process for forming images.

The first object of the present invention has been attained by the development of color developing agents represented by the following formula (I). The second and third objects of the present invention have been accomplished by the development of color diffusion transfer silver halide photographic materials which contain the color developing agents represented by formula (I) in at least one hydrophilic colloid layer provided on a support:

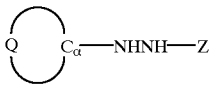

(I)

wherein $C_\alpha$ represents a carbon atom; Z represents a carbamoyl group, an acyl group, an alkoxycarbonyl group, or an aryloxycarbonyl group; and Q represents an atomic group for forming a unsaturated ring together with $C_\alpha$.

DETAILED DESCRIPTION OF THE INVENTION

The compounds represented by formula (I) used in the present invention are described below in detail.

In formula (I), Z represents a carbamoyl group, an acyl group, an alkoxycarbonyl group, or an aryloxycarbonyl group. Of these groups, the carbamoyl group is preferred, and particularly, the carbamoyl group having at least one hydrogen atom on its nitrogen atom is preferred.

The carbamoyl group preferably has 1 to 50 carbon atoms, and more preferably has 1 to 40 carbon atoms. Examples thereof include a carbamoyl group, a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-tert-pentylphenoxy)-propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxyphenylcarbamoyl group, a benzyloxycarbamoyl group, and a 2,5-dioxo-1-pyrrolidinylcarbamoyl group.

The acyl group preferably has 1 to 50 carbon atoms, and more preferably 1 to 40 carbon atoms. Examples thereof include a formyl group, an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoly group, and a 3-(N-hydroxy-N-methylaminocarbonyl)propanoyl group.

The alkoxycarbonyl and aryloxycarbonyl groups preferably have 2 to 50 carbon atoms, and more preferably 2 to 40 carbon atoms, respectively. Examples thereof include a methoxy-carbonyl group, an ethoxycarbonyl group, an isobutyloxy-carbonyl group, a cyclohexyloxycarbonyl group, a dodecyoxy-carbonyl group, a benzyloxycarbonyl group, a phenoxycarbonyl group, a 4-octyloxyphenoxycarbonyl group, a 2-hydroxymethyl-phenoxycarbonyl group, and a 4-dodecyloxyphenoxycarbonyl group.

Q represents an atomic group for forming a unsaturated ring together with $C_\alpha$. The unsaturated ring formed is preferably a 3- to 8-membered ring, and more preferably a 5- and 6-membered ring. Examples of preferred rings include a benzene ring, a pyridine ring, a pyrazine ring, a pyrimidine ring, a pyridazine ring, an 1,2,4-triazine ring, an 1,3,5-triazine ring, a pyrrole ring, an imidazole ring, a pyrazole ring, an 1,2,3-triazole ring, an 1,2,4-triazole ring, a tetrazole ring, an 1,3,4-thiadiazole ring, an 1,2,4-thiadiazole ring, an 1,2,5-thiadiazole ring, an 1,3,4-oxadiazole ring, an 1,2,4-oxadiazole ring, an 1,2,5-oxadiazole ring, a thiazole ring, an oxazole ring, an isothiazole ring, an isoxazole ring, and a thiophene ring. Further, condensed rings formed from these rings also are preferably used. These rings can further contain a substituent group. Examples of the substituent group include a straight-chain, branched-chain, and cyclic alkyl group having 1 to 50 carbon atoms (for example, trifluoromethyl, methyl, ethyl, propyl, heptafluoro-propyl, isopropyl, butyl, t-butyl, t-pentyl, cyclopentyl, cyclohexyl, octyl, 2-ethylhexyl, and dodecyl), a straight-chain, branched-chain, and cyclic alkenyl group having 2 to 50 carbon atoms (for example, vinyl, 1-methylvinyl, and cyclohexen-1-yl), an alkynyl group having of 2 to 50 carbon atoms (for example, ethynyl and 1-propynyl), an aryl group having 6 to 50 carbon atoms (for example, phenyl, naphthyl, and anthryl), an acyloxy group having 1 to 50 carbon atoms (for example, acetoxy, tetradecanoyloxy, and benzoyloxy), a carbamoyloxy group having 1 to 50 carbon atoms (for example, N,N-dimethylcarbamoyloxy), a carbonamido group having 1 to 50 carbon atoms (for example, formamido, N-methylacetamido, acetamido, N-methylformamido, and benzamido), a sulfonamido group having 1 to 50 carbon atoms (for example, methanesulfonamido, dodecansufonamido, benzenesulfonamido, and p-toluenesulfonamido), a carbamoyl group having 1 to 50 carbon atoms (for example N-methylcarbamoyl, N,N-diethylcarbamoyl and N-mesylcarbamoyl), a sulfamoyl group having 0 to 50 carbon atoms (for example, N-butylsulfamoyl, N,N-diethylsulfamoyl, and N-methyl-N-(4-methoxyphenyl) sulfamoyl), an alkoxy group having 1 to 50 carbon atoms (for example, methoxy, propoxy, isopropoxy, octyloxy, t-octyloxy, dodecyloxy, 2-(2,4-di-t-pentylphenoxy)ethoxy), an aryloxy group having 6 to 50 carbon atoms (for example, phenoxy, 4-methoxyphenoxy and naphthoxy), an aryloxy-carbonyl group having 7 to 50 carbon atoms (for example, phenoxycarbonyl and naphthoxycarbonyl), an alkoxycarbonyl group having 2 to 50 carbon atoms (for example, methoxycarbonyl and t-butoxycarbonyl), an N-acylsulfamoyl group (for example, N-tetradecanoylsulfamoyl and N-benzoylsulfamoyl), an alkylsulfonyl group having 1 to 50 carbon atoms (for example, methanesulfonyl, octylsulfonyl, 2-methoxyethylsulfonyl, and 2-hexyldecylsulfonyl), an arylsulfonyl group having 6 to 50 carbon atoms (for example, benzenesulfonyl, p-toluenesulfonyl, and 4-phenylsulfonylphenylsulfonyl), an alkoxycarbonylamino group having 2 to 50 carbon atoms (for example, ethoxycarbonylamino), an aryloxycarbonylamino group having 7 to 50 carbon atoms (for example, phenoxycarbonylamino and naphthoxycarbonylamino), an amino group having 0 to 50carbon atoms (for example, amino, methylamino, diethylamino, diisopropylamino, anilino, and morpholino), a cyano group, a nitro group, a carboxyl group, a hydroxy group, a sulfo group, a mercapto group, an alkylsulfinyl group having 1 to 50 carbon atoms (for example, methanesulfinyl and octanesulfinyl), an arylsulfinyl group having 6 to 50 carbon atoms (for example, benzenesulfinyl, 4-chlorophenylsulfinyl and p-toluenesulfinyl), an alkylthio group having 1 to 50 carbon atoms (for example, methylthio, octylthio and cyclohexylthio), an arylthio group having 6 to 50 carbon atoms (for example, phenylthio and naphthylthio), a ureido group having 1 to 50 carbon atoms (for example, 3-methylureido, 3,3-dimethylureido and 1,3-diphenylureido), a heterocyclic group having 2 to 50 carbon atoms (a 3- to 12-membered monocycles or condensed ring containing at least one or more heteroatoms such as nitrogen, oxygen, or sulfur; for example, 2-furyl, 2-pyranyl, 2-pyridyl, 2-thienyl, 2-imidazolyl, morpholino, 2-quinolyl, 2-benzimidazolyl, 2-benzothiazolyl, and 2-benzoxazolyl), an acyl group having 1 to 50 carbon atoms (for example, acetyl, benzoyl and trifluoroacetyl), a sulfamoylamino group having 0 to 50 carbon atoms (for example, N-butylsulfamoylamino and N-phenylsulfamoylamino), a silyl group having 3 to 50 carbon atoms (for example, trimethylsilyl, dimethyl-t-butylsilyl and triphenylsilyl), a halogen atom (for example, fluorine, chlorine, and bromine). These substituent groups may further contain a substituent group, examples of which include the substituent groups described herein.

The carbon numbers of the substituent groups are preferably 50 or less, and more preferably 42 or less. The total carbon numbers of the unsaturated rings formed from Q and $C_\alpha$ and the substituent groups contained therein are preferably 30 or less, more preferably 24 or less, and most preferably 18 or less.

When a ring formed from Q and $C_\alpha$ is constituted of only carbon atoms (for example, a benzene ring, a naphthalene ring, or an anthracene ring), the sum of Hammett substituent constants (δ values) of substituent groups on the ring is 0.8 or more, more preferably 1.2 or more, and most preferably 1.5 or more ($\delta_p$ values are applied to the substituent groups at the positions having electronically conjugated relationship (e.g., the 2- or 4-position) to $C_\alpha$ and $\delta_m$ values are applied to the substituent groups at the positions having no electronically conjugated relationship (e.g., the 3- or 5-position) to $C_\alpha$), and the upper limit thereof is preferably 3.5, and more preferably 3.0.

When a ring formed from Q and $C_\alpha$ is a heterocycle (heterocyclic ring), the heterocycle preferably contains one or more substituent groups, $\delta_p$ values of which are positive.

Hammett substituent constants, $C_\alpha$ and $\delta_m$ are illustrated in detail, for example, in Naoki Inamoto, *Hamettosoku: Kozo to Hannosei* (*Hammett's Rule; Structure and Reactivity*), (Maruzen); *Shin-Jikkenkagakukoza* 14*; Yukikagohbutsu no Gosei to Hanno V* (*New Lecture on Experimental Chemistry* 14*; Syntheses and Reactions of Organic Compounds V*), page 2605 (Edited by Japanese Chemical Society, Maruzen); Tadao Nakaya, *Riron Yukikagaku Kaisetsu* (*Exposition of Theoretical Organic Chemistry*), page 217 (Tokyo Kagaku Dohjin); and *Chemical Reviews*, Vol.91, pp.165–195 (1991).

Examples of the color developing agents represented by formula (I) are shown below. However, the scope of the present invention is not limited by these examples.

(1)
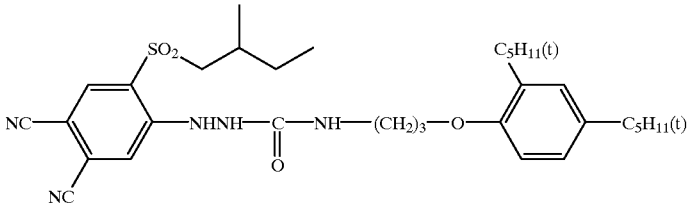
(2)
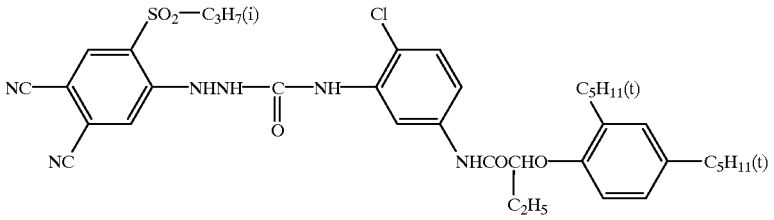
(3)
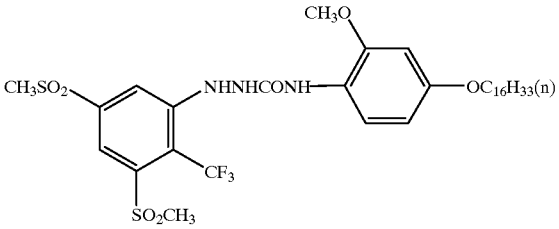
(4)
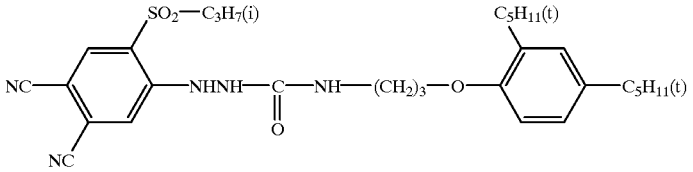
(5)
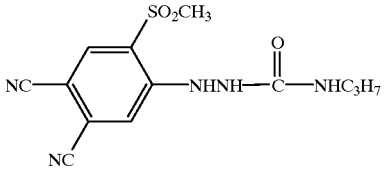
(6)
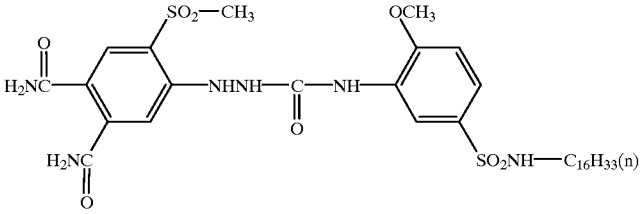
(7)
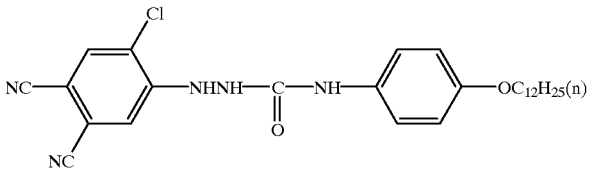

-continued
(8)
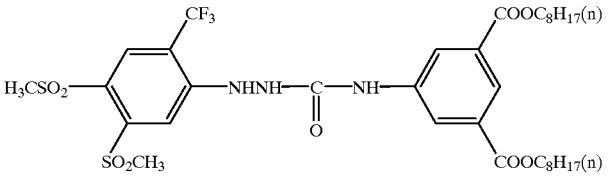
(9)
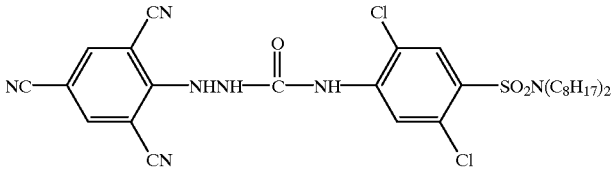
(10)
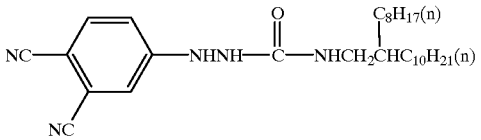
(11)
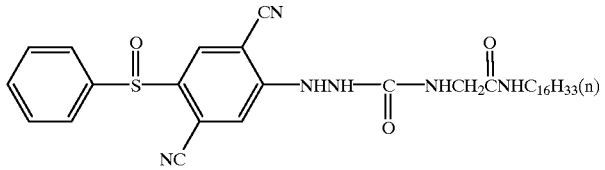
(12)
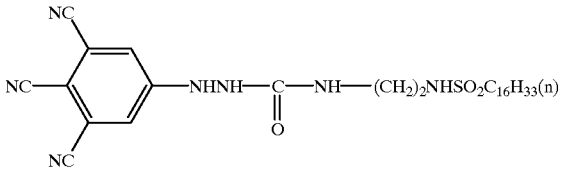
(13)
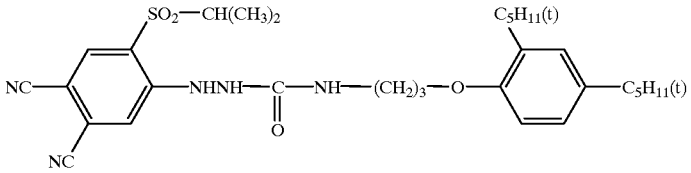
(14)
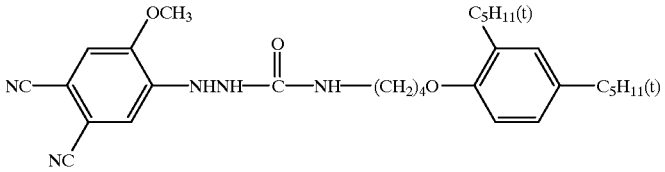
(15)
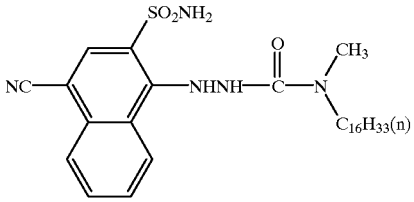

-continued
(16)
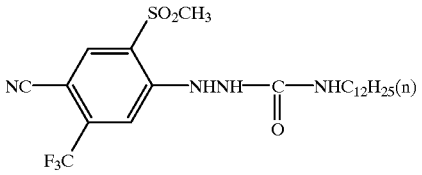
(17)
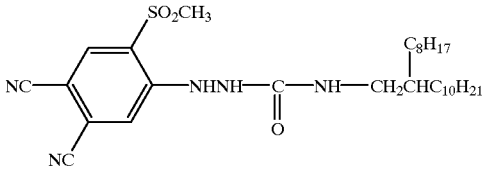
(18)
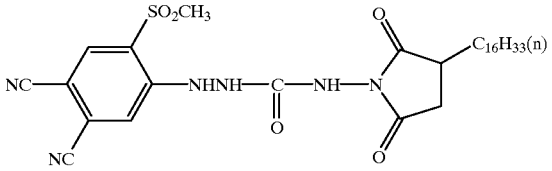
(19)
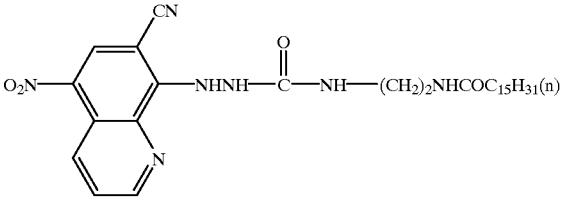
(20)
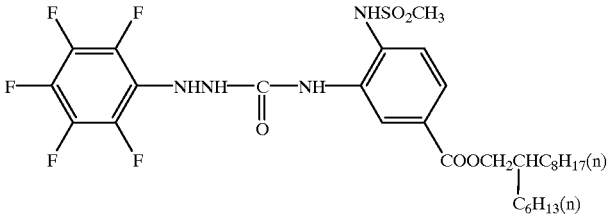
(21)
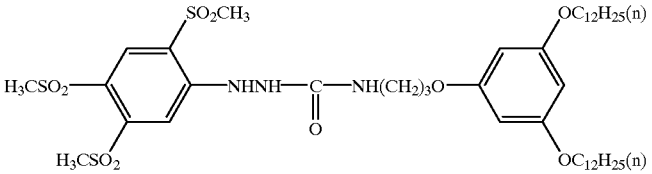
(22)
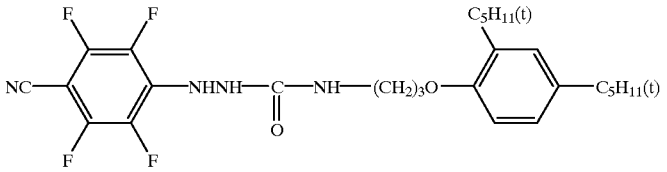
(23)
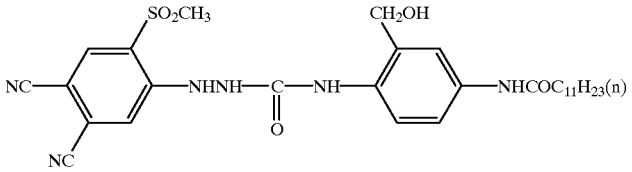

-continued
(24)
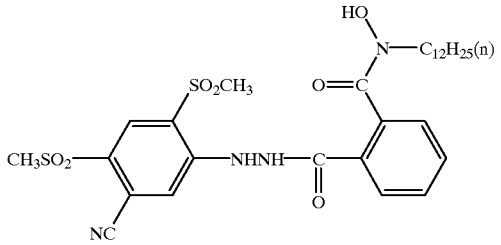
(25)
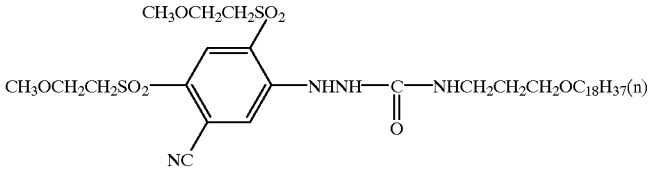
(26)
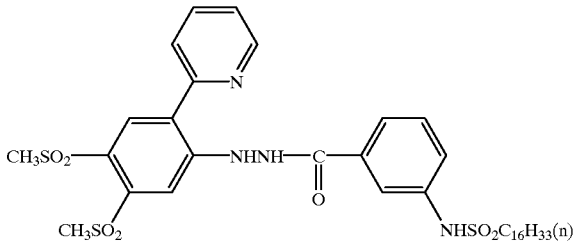
(27)
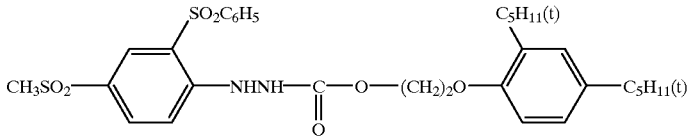
(28)
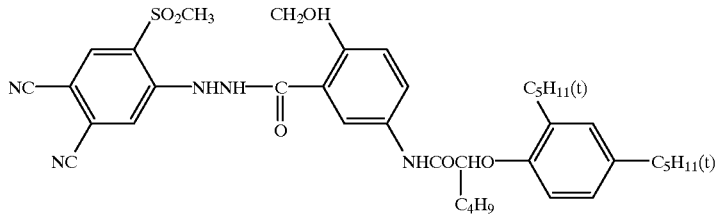
(29)
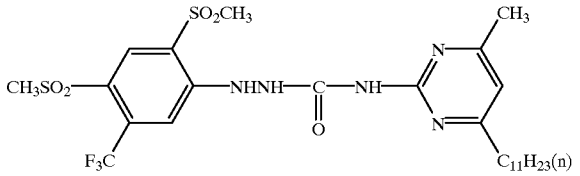
(30)
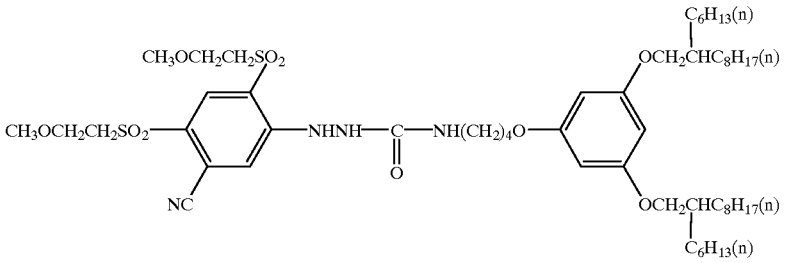

-continued
(31)
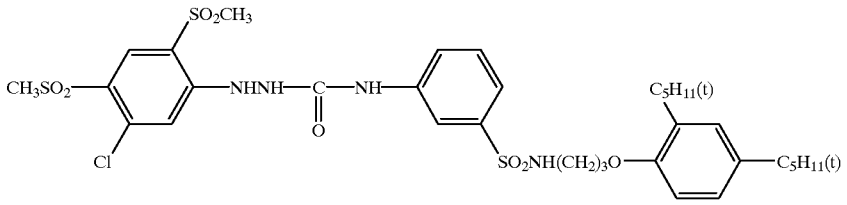
(32)
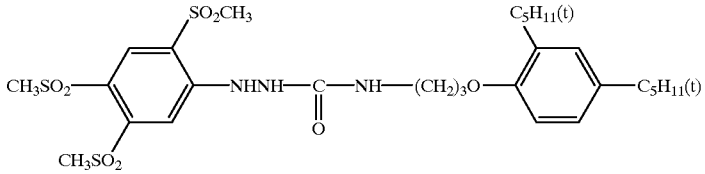
(33)
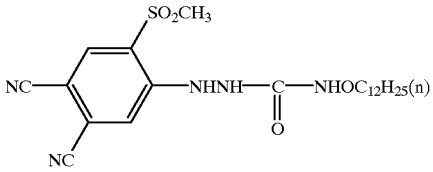
(34)
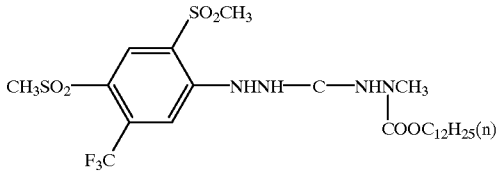
(35)
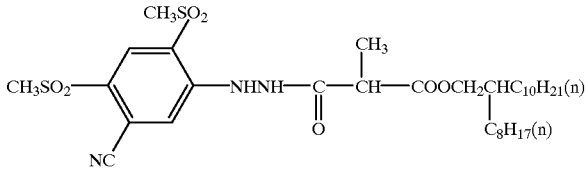
(36)
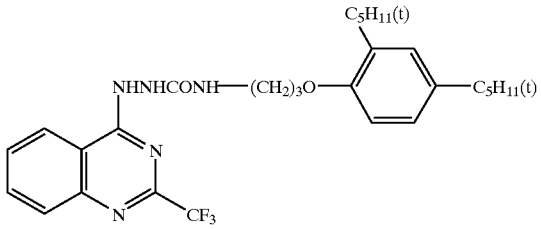
(37)
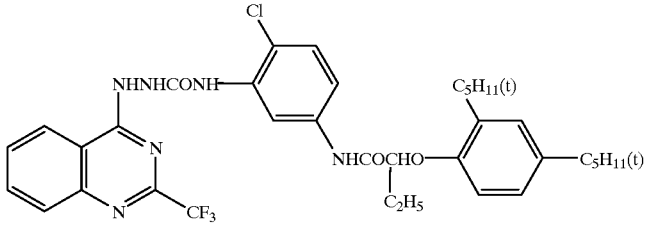

-continued
(38)
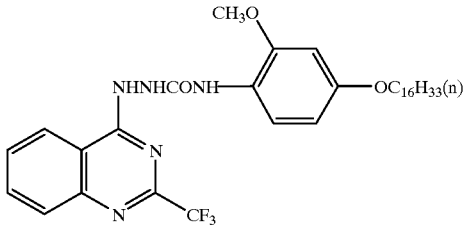
(39)
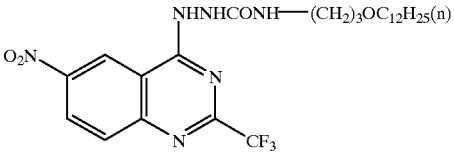
(40)
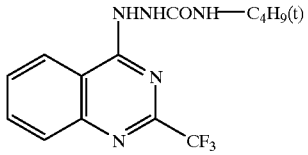
(41)
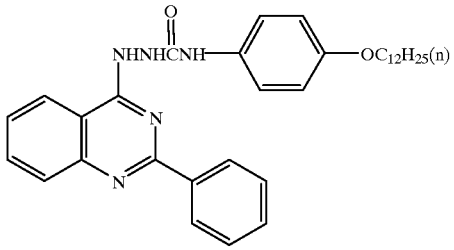
(42)
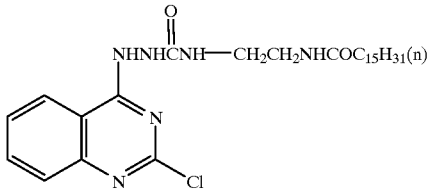
(43)
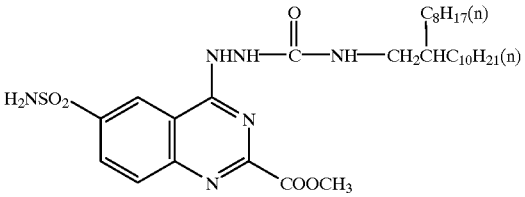
(44)
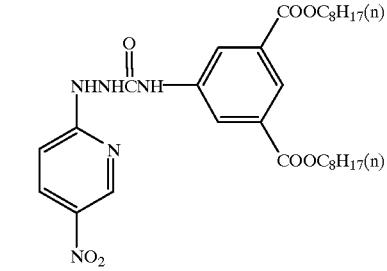

-continued
(45)
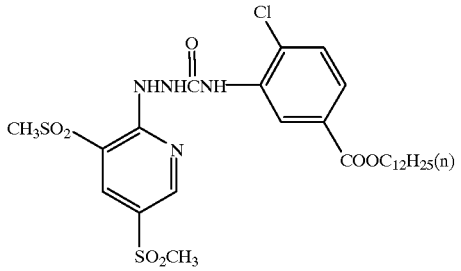
(46)
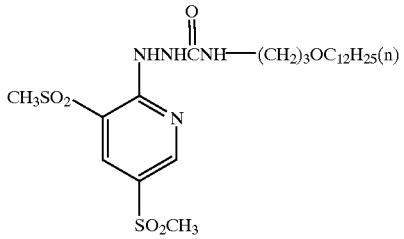
(47)
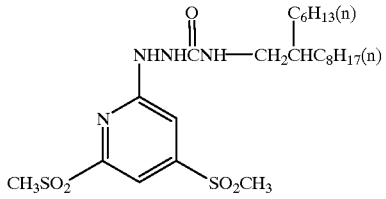
(48)
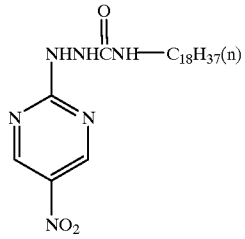
(49)
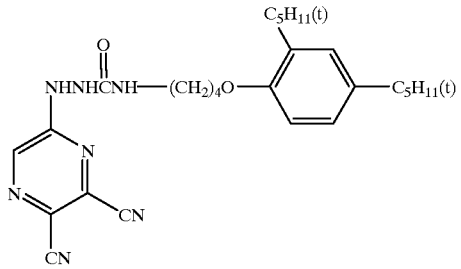
(50)
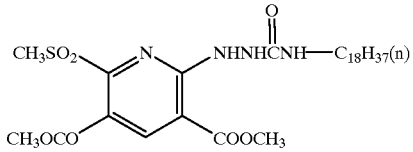

-continued
(51)
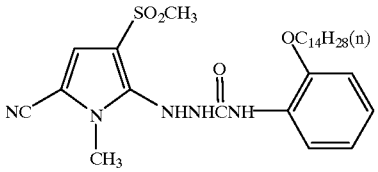
(52)
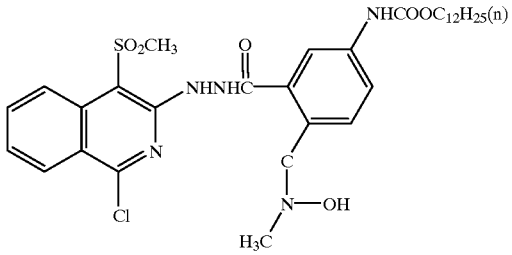
(53)
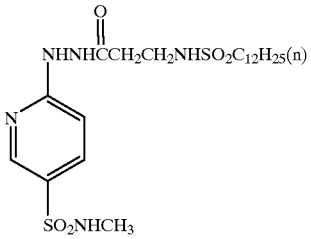
(54)
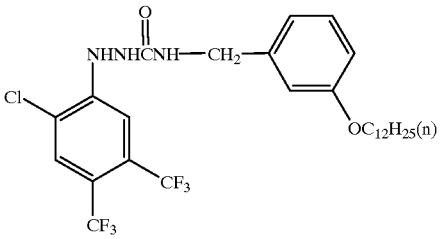
(55)
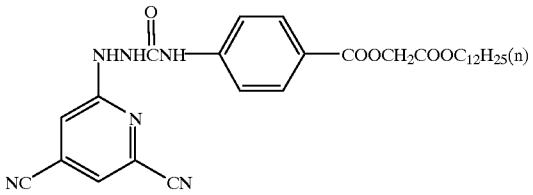
(56)
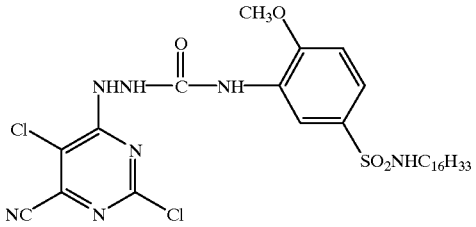

-continued
(57)
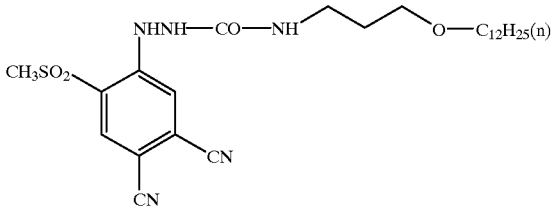
(58)
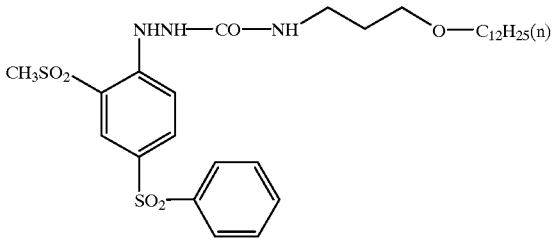
(59)
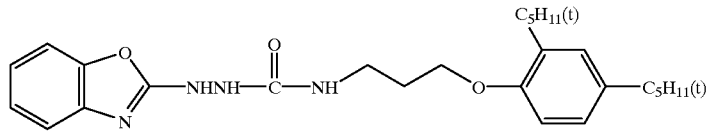
(60)
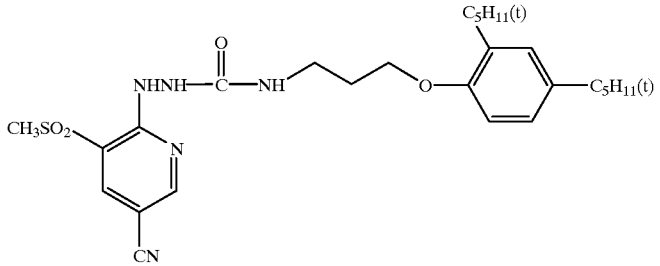
(61)
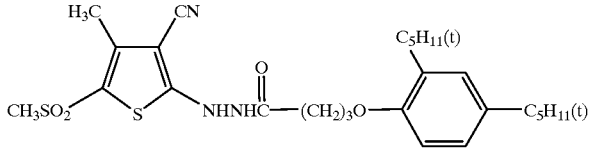
(62)
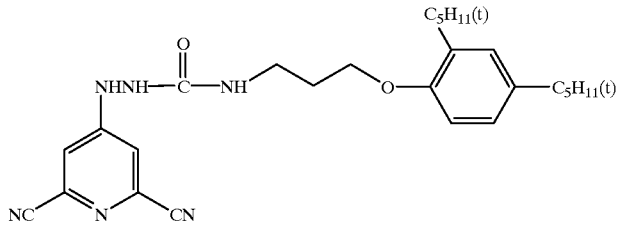
(63)
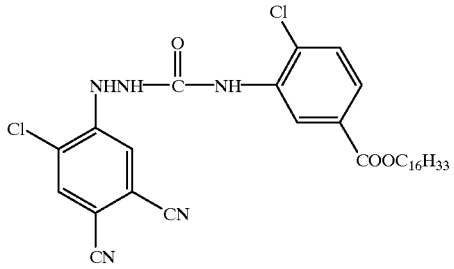

-continued (64)

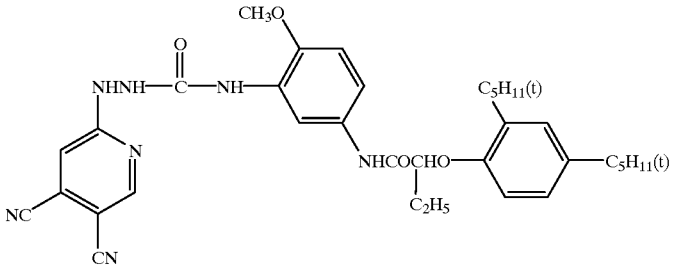

(65)

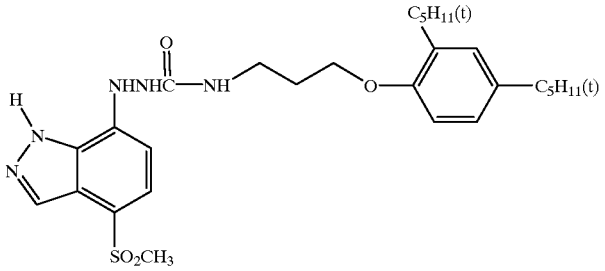

General procedures for preparing the compounds of the present invention are described below. Examples of synthesis of typical compounds used in the present invention are shown below, and other compounds than the compounds described here can also be similarly prepared.

Synthesis Example 1. Synthesis of Compound (5)

Compound (5) was prepared according to the following scheme.

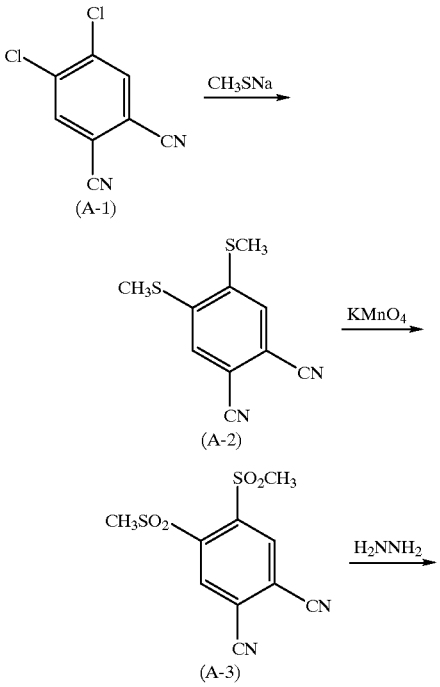

-continued

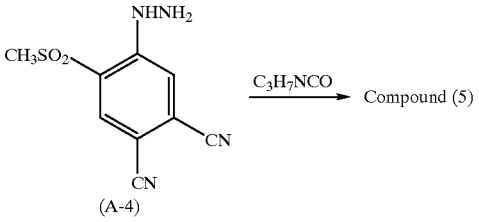

Synthesis of Compound (A-2)

In 1.1 liters of N,N-dimethylformamide (DMF), 53.1 g of 1,2-dichloro-4,5-dicyanobenzene (A-1) (CAS Registry No. 139152-08-2) was dissolved, and 268 g of a 15% aqueous solution of sodium methanethiolate was dropwise added to the solution at room temperature over an 1-hour period. The reaction mixture was further stirred at 60° C. for 1 hour, cooled to room temperature, poured into water, and further, stirred for 30 minutes. A white solid formed was collected by filtration, washed with water, and dried. Yield: 46.5 g (78.1%).

Synthesis of Compound (A-3)

To 41.1 g of compound (A-2) suspended in 400 ml of acetic acid, 89.3 g of potassium permanganate dissolved in 400 ml of water was dropwise added over an 1-hour period under cooling with water. The reaction mixture was allowed to stand overnight, and 2 liters of water and 2 liters of ethyl acetate were added thereto. The mixture was filtered with the aid of cerite, and the filtrate was separated. The organic phase was successively washed with water, aqueous sodium hydrosulfite, aqueous sodium bicarbonate, and brine, and dried over anhydrous magnesium sulfate. After filtration, the solvent was removed by distillation, a mixture of ethyl acetate and hexane was added to the residue to obtain 29.4 g of compound (A-3) as a white solid. Yield: 55.0%.

Synthesis of Compound (A-4)

To 29.4 g of compound (A-3) dissolved in 200 ml of dimethylsulfoxide (DMSO), 8.7 g of hydrazine hydrate was dropwise added over a 15-minute period under cooling with water, and the resulting mixture was further stirred for 10 minutes under cooling with water. The reaction mixture was poured into water, and a yellow solid formed was collected by filtration, washed with water, and then dried. Yield: 17.4 g (70.9%).

Synthesis of Compound (5)

To 11.8 g of compound (A-4) dissolved in 50 ml of tetrahydrofuran, 4.7 g of propyl isocyanate was dropwise added at room temperature over a 30-minute period, and the resulting mixture was further stirred for 1 hour, poured into water, and extracted with ethyl acetate. The organic phase was washed with hydrochloric acid and brine, and then dried over anhydrous magnesium sulfate. After filtration, the solvent was removed by distillation. A mixture of ethyl acetate and hexane (1:10) was added to the residue to obtain 14.5 g of compound (5) as a white solid. Yield: 90.2%.

Synthesis Example 2. Synthesis of Compound (2)

Compound (2) was prepared according to the following scheme.

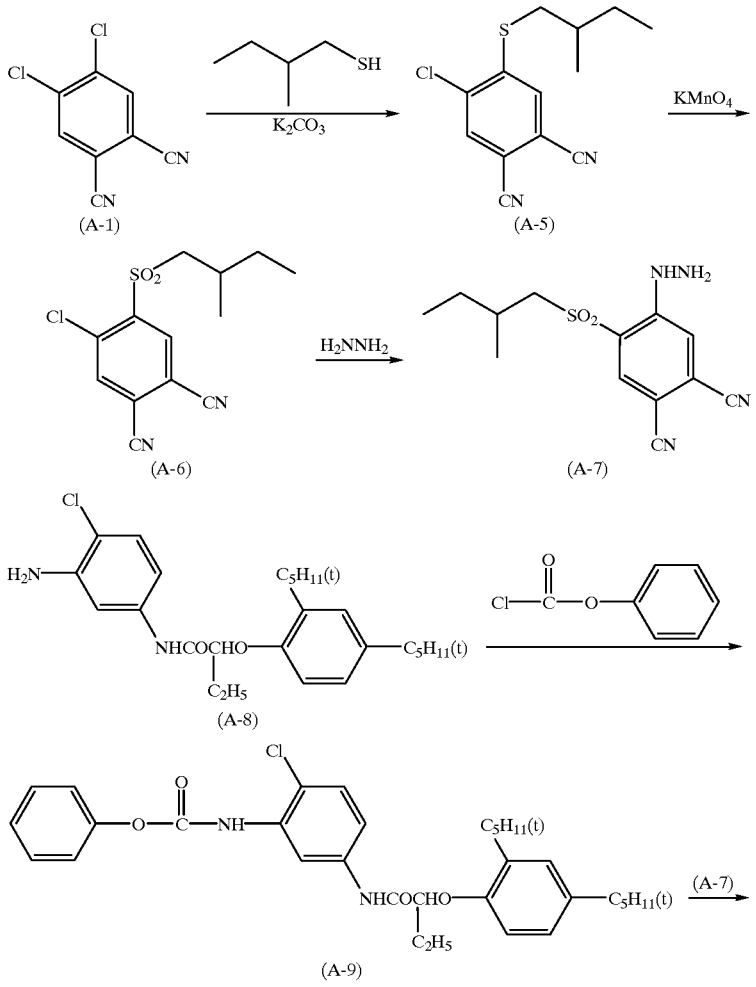

Synthesis of Compound (A-5)

To 84.7 g of compound (A-1) and 89.8 g of potassium carbonate suspended in 600 ml of DMF, 60.3 ml of 2-methylbutyl mercaptan was dropwise added at room temperature over an 1-hour period. The reaction mixture was further stirred at rood temperature for 1 hour, poured into water, and stirred for 10 minutes. A white solid formed was collected by filtration, washed with water, and then dried. Yield: 100.8 g (88.5%).

Synthesis of Compound (A-6)

To 98.0 g of compound (A-5) suspended in 500 ml of acetic acid and 500 ml of water, 88.5 g of potassium permanganate dissolved in 500 ml of water was dropwise added at room temperature over an 1-hour period, and stirring was further continued at room temperature for 2 hours. To the reaction mixture, 2 liters of water and 2 liters of ethyl acetate were added, and the resulting mixture was filtrated with the aid of cerite. The filtrate was separated, and the organic phase was successively washed with water, aqueous hydrosulfite, aqueous sodium bicarbonate, and brine, and then dried over anhydrous magnesium sulfate. After filtration, the solvent was removed by distillation, and isopropyl alcohol was added to the residue to obtain 53.2 g of compound (A-6) as a white solid. Yield: 48.4%.

Synthesis of Compound (A-7)

To 50.5 g of compound (A-6) dissolved in 100 ml of DMSO, 17.0 g of hydrazine hydrate was dropwise added over a 10 minute period under cooling with ice, and stirring was further continued at room temperature for 30 minutes. The reaction mixture was poured into water, and extracted with ethyl acetate. The organic phase was washed with water, and dried over anhydrous magnesium sulfate. After filtration, the solvent was removed by distillation, and the residue was purified by column chromatography on silica gel. Methylene chloride was used as an elute. The product was crystallized from a mixture of ethyl acetate and hexane (1:2) to obtain 31.4 g of compound (A-7) as a yellow solid. Yield: 63.2%.

Synthesis of Compound (A-9)

To 44.5 g of compound (A-8) (CAS Registry No.51461-11-1) dissolved in 500 ml of ethyl acetate, 25 g of sodium bicarbonate dissolved in 500 ml of water was added, and 16.4 g of phenyl chlorocarbonate was dropwise added to the resulting mixture at room temperature over a 30-minute period. The reaction mixture was further stirred for 1 hour. The organic phase was separated from the mixture, washed with brine, and dried over anhydrous magnesium sulfate. After filtration, the solvent was removed by distillation to obtain 54.0 g of compound (A-9) as pale yellow oil. Yield: 95.6%.

Synthesis of Compound (2)

In 100 ml of acetonitrile, 5.8 g of compound (A-7), 11.3 g of compound (A-9) and 0.60 g of N,N-dimethylaminopyridine (DMAP) were dissolved, and the solution was stirred at 60° C. for 3 hours. The reaction mixture was poured into water, and extracted with ethyl acetate. The organic phase was washed with aqueous sodium bicarbonate, hydrochloric acid, and brine, and dried over anhydrous magnesium sulfate. After filtration, the solvent was removed by distillation, and the residue was purified by column chromatography on silica gel (elute: ethyl acetate/hexane=½). The product was crystallized from hexane to obtain 8.0 g of compound (2) as a white solid. Yield: 52.4%.

Synthesis Example 3. Synthesis of Compound (1)

Compound (1) was prepared according to the following scheme.

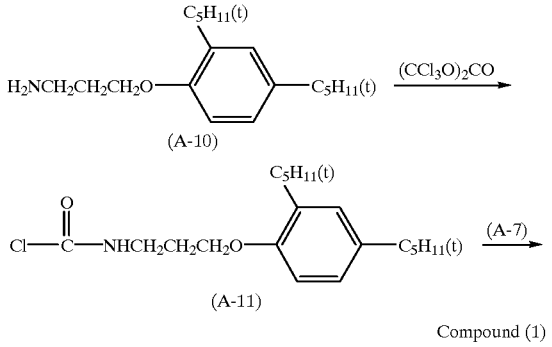

Synthesis of Compound (1)

To 4.6 g of triphosgene dissolved in 100 ml of THF, 13.6 g of compound (A-10) (CAS Registry No.61053-26-7) was dropwise added at room temperature over a 10-minute period, and subsequently, 18.7 g ml of triethylamine was dropwise added at room temperature over a 10-minute period. The reaction was further continued for 30 minutes to obtain a solution of compound (A-11). To this solution, 13.0 g of compound (A-7) was added by portions at room temperature over a 10-minute period. The mixture was further stirred for 1 hour, poured into water, and extracted with ethyl acetate. The organic phase was washed with aqueous sodium bicarbonate, hydrochloric acid and brine, and dried over anhydrous magnesium sulfate. After filtration, the solvent was removed by distillation, and the residue was purified by column chromatography on silica gel. The product was crystallized from a mixture of ethyl acetate and hexane (1:10) to obtain compound (1) as a white solid. Yield: 17.0 g (61.3%).

Synthesis Example 4. Synthesis of Compound (37)

Compound (37) was prepared according to the following scheme.

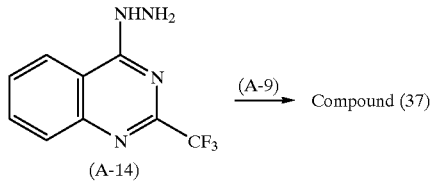

Similarly to synthesis example 2, compound (37) was obtained as a white solid by use of 6.0 g of compound (A-14) (described in European Patent 545,491A1), 14.98 g of compound (A-9) and 0.5 g of DMAP. Yield: 12.0 g (65.3%).

Synthesis Example 5. Synthesis of Compound (36)

Similarly to synthesis example 3, compound (36) was obtained as a white solid by use of compound A-11) prepared from 5.8 g of compound (A-10) similarly to synthesis example 3 and 4.3 g of compound (A-14). Yield: 6.7 g (61.5%).

The color developing agents of the present invention are used together with compounds (couplers) from which dyes are formed by an oxidative coupling reaction. The couplers may be used as compounds different from the color developing agents of the present invention or as compounds chemically linked to the color developing agents of the present invention.

In the present invention, it is preferred that the couplers are the so-called "two equivalent couplers" used in the conventional color photographic systems in which p-phenylenediamine color developing agents are used. Examples of the couplers are described in detail in *Theory of the Photographic Process* (4th edition, Edited by T. H. James, MacMillan, 1977), pp.291–334 and pp.354–361; JP-A-58-12353 (The term "JP-A" as used herein means an "unexamined published Japanese patent application"), JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474, JP-A-60-66249, etc.

Couplers used preferably in the present invention are nondiffusive couplers, or those which vary from nondiffusive to diffusible couplers before and after processing according to the process described as "blocked photographic chemicals" described later. Examples thereof are enumerated below.

For the couplers used preferably in the present invention, there are compounds having structures represented by the following formulas (1) to (12). In general, these compounds are those which are called active methylene, pyrazolone, pyrazoloazole, phenol, naphthol, and pyierolotriazole, and are known compounds in this field.

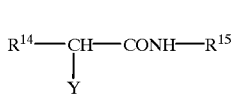

(1)

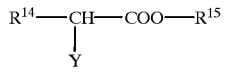

(2)

-continued (3)

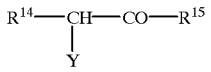

(4)

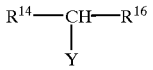

(5)

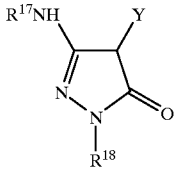

(6)

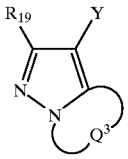

(7)

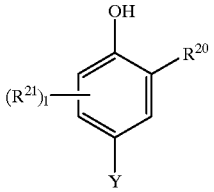

(8)

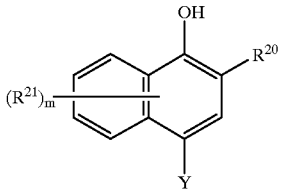

(9)

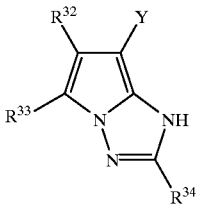

(10)

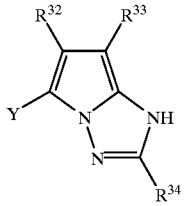

-continued (11)

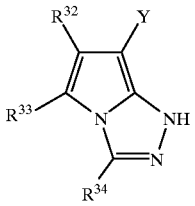

(12)

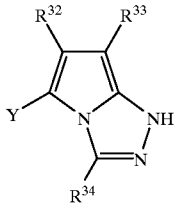

Compounds represented by formulas (1) to (4) are called active methylene type couplers, and $R^{14}$ in the formulas is an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group. These groups may contain a substituent group.

In formulas (1) to (3), $R^{15}$ is an alkyl group, an aryl group, or a heterocyclic residue, which may contain a substituent group. In formula (4), $R^{16}$ is an aryl group or a heterocyclic residue, which may contain a substituent group. The substituent group which $R^{14}$, $R^{15}$ and $R^{16}$ may contain can include those which are presented as the substituent groups on the rings formed from Q and $C_{\alpha}$ as described above.

In formulas (1) to (4), Y is preferably a group which affords nondiffusibility to the coupler and can be released from the coupler by the coupling reaction with the oxidation product of a developing agent. Examples of the releasing moiety (Y) include a heterocyclic ring (a saturated or unsaturated 5- to 7-membered monocyclic or condensed-ring compound which contains at least one nitrogen, oxygen, sulfur, or the like as a heteroatom, and examples thereof include succinimide, maleinimide, phthalimide, diglycolimide, pyrrole, pyrazole, imidazole, 1,2,4-triazole, tetrazole, indole, benzopyrazole, benzimidazole, benzotriazole, imidazoline-2,4-dione, oxazolidine-2,4-dione, thiazolidine-2,4-dione, imidazolidin-2-one, oxazolin-2-one, thiazolin-2-one, benzimidazolin-2-one, benzoxazolin-2-one, benzothiazolin-2-one, 2-pyrrolin-5-one, 2-imidazolin-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, 2-imino-1,3,4-thiazolidin-4-one, etc.), a halogen atom (for example, chlorine and bromine), an aryloxy group (for example, phenoxy and 1-naphthoxy), a heterocycle-oxy group (for example, pyridyloxy and pyrazolyloxy), an acyloxy group (for example, cyclohexylcarbonyl and benzoyloxy), an alkoxy group, a carbamoyloxy group (for example, N,N-didodecylcarbamoyloxy and morpholinocarbonyloxy), an aryloxycarbonyloxy group (for example, phenoxycarbonyloxy), an alkoxycarbonyloxy group, an arylthio group (for example, phenylthio and naphthylthio), a heterocycle-thio group (for example, tetrazolylthio, 1,3,4-thiadiazolylthio, 1,3,4-oxadiazolylthio, and benzimidazolylthio), an alkylthio group (for example, methylthio, octylthio and hexadecylthio), an alkylsulfonyloxy group, an arylsulfonyloxy group (for example, benzenesulfonyloxy and toluenesulfonyloxy), a carbonamido group (for example, undecylcarbonylamino and phenylcarbonylamino), a sulfonamido group (for example, dodecylsulfonamido and benzenesulfonamido), an alkylsulfonyl group, an arylsulfonyl group (for example, benzenesulfonyl), an alkylsulfinyl group (for example, octylsulfinyl), an arylsulfinyl group (for example, benzenesulfinyl), and a carbamoylamino group (for example, N-hexadecylcarbamoylamino).

Of these groups, preferred releasing moieties (Y) are the aryloxy group, the heterocycle-oxy group, the acyloxy group, the carbamoyloxy group, the aryloxycarbonyloxy group, the arylthio group, the heterocycle-thio group, the alkylsulfonyloxy group, and the arylsulfonyloxy group, and very preferred releasing moieties are the aryloxy group, the heterocycle-oxy group, the acyloxy group, the aryloxycarbonyloxy group, the alkoxycarbonyloxy group, and the carbamoyloxy group.

To afford nondiffusibility to the coupler, Y may contain a substituent group, and examples of such a substituent group include the substituent groups described above as those on the rings formed from Q and $C_\alpha$. The total number of carbon atoms contained in Y preferably ranges from 6 to 50, more preferably from 8 to 40, and most preferably from 10 to 30.

In formulas (1) to (4), $R^{14}$ and $R^{15}$ or $R^{14}$ and $R^{16}$ may combine with each other to form preferably a 5- to 7-membered ring, and more preferably a 5- and 6-membered ring.

Compounds represented by formula (5) are those which are called 5-pyrazolone type couplers, and $R^{17}$ in the formula represents an alkyl group, an aryl group, an acyl group, or a carbamoyl group. $R^{18}$ represents a phenyl group or a phenyl group substituted by one or more of halogen atoms, an alkyl group, a cyano group, an alkoxy group, an alkoxycarbonyl group, and a phenyl group substituted by an acylamino group.

Of the 5-pyrazolone type couplers represented by formula (5), preferred couplers are those which contain an aryl group or an acyl group as $R^{17}$ and a phenyl group substituted by one or more halogen atoms as $R^{18}$. Specifically, examples of groups used preferably as $R^{17}$ include an aryl group such as a phenyl group, a 2-chlorophenyl group, a 2-methoxyphenyl group, a 2-chloro-5-tetradecanamidophenyl group, a 2-chloro-5-(3-octadecenyl-1-succinimido)phenyl group, a 2-chloro-5-octadecylsulfonamidophenyl group, or a 2-chloro-5-[2-(4-hydroxy-3-t-butylphenoxy) tetradecanamido]-phenyl group; and an acyl group such as an acetyl group, a 2-(2,4-di-t-pentylphenoxy)butanoyl group, a benzoyl group, or a 3-(2,4-di-t-amylphenoxyacetamido)benzoyl group. These groups may further contain a substituent group, examples of which include an organic substituent group linked to these groups via a carbon atom, an oxygen atom, a nitrogen atom, or a sulfur atom, and a halogen atom. Y has the same meanings as above.

Substituted phenyl groups used preferably as $R^{18}$ are a 2,4,6-trichlorophenyl group, a 2,5-dichlorophenyl group, a 2-chlorophenyl group, etc.

Compounds represented by formula (6) are those which are called pyrazoloazole type couplers, and $R^{19}$ in the formula represents a hydrogen atom or a substituent group. $Q^3$ represents a group of nonmetallic atoms necessary to form a 5-membered azole ring containing 2 to 4 nitrogen atoms, and the azole ring may contain a substituent group (including a condensed ring).

Of the pyrazoloazole type couplers represented by formula (6), imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067 are preferred from the viewpoint of spectral absorption characteristics of formed dyes.

Substituent groups represented by $R^{19}$ and substituent groups on the azole rings completed by $Q^3$ are described in detail, for example, in U.S. Pat. No. 4,540,654, column 2, line 41 to column 8, line 27.Preferred examples thereof include pyrazoloazole couplers to which a branched alkyl group is directly linked at the 2-, 3-, or 6-position of a pyrazolotriazole group as described in JP-A-61-65245, pyrazoloazole couplers containing a sulfonamido group in molecules as described in JP-A-61-65245, pyrazoloazole couplers containing an alkoxyphenylsulfonamido ballasting group as described in JP-A-61-147254, pyrazolotriazole couplers substituted by an alkoxy group or an aryloxy group at the 6-position as described in JP-A-62-209457, and pyrazolotriazole couplers containing a carbonamido group in molecule as described in JP-A-2-201443. Y has the same meanings as above.

Compounds represented by formulas (7) and (8) are those which are called phenyl type couplers and naphthol type couplers, respectively. In the formulas, $R^{20}$ represents a hydrogen atom or a group selected from among $—CONR^{22}R^{23}$, $—SO_2NR^{22}R^{23}$, $—NHCOR^{22}$, $—NHCONR^{22}R^{23}$, and $—NHSO_2NR^{22}R^{23}$. $R^{22}$ and $R^{23}$ each represent a hydrogen atom or a substituent group. In formulas (7) and (8), $R^{21}$ represents a substituent group; 1 represents an integer of 0 to 2; and m an integer of 0 to 4. When 1 or m is 2 or more, $R^{21}$s may be different from one another. Examples of substituent groups represented by $R^{21}$ to $R^{23}$ include those which are described above as the substituent groups on rings formed from Q and $C_\alpha$. Y has the same meanings as above.

Examples of preferred phenol type couplers represented by formula (7) include 2-acylamino-5-alkylphenol type couplers described in U.S. Pat. Nos. 2,369,929, 2,801,171, 2,772,162, 2,895,826, 3,772,002, etc.; 2,5-diacylaminophenol type couplers described in U.S. Pat. Nos. 2,772,162, 3,758,308, 4,126,396, 4,334,011, and 4,327,173, West German Patent (OLS) No.3,329,729, JP-A-59-166956, etc.; and 2-phenylureido-5-acylaminophenol type couplers described in U.S. Pat. Nos. 3,446,622, 4,333,999, 4,451,559, 4,427,767, etc. Y has the same meanings as above.

Examples of preferred naphthol type couplers represented by formula (8) include 2-carbamoyl-1-naphthol type couplers described in U.S. Pat. Nos. 2,474,293, 4,052,212, 4,146,396, 4,282,233, 4,296,200, etc.; and 2-carbamoyl-5-amido-1-naphthol type couplers described in U.S. Pat. No. 4,690,889, etc. Y has the same meanings as above.

Compounds represented by formulas (9) to (12) are couplers called pyrrolotriazoles, and $R^{32}$, $R^{33}$ and $R^{34}$ each represent a hydrogen atom or a substituent group. Y has the same meanings as above. Substituent groups represented by $R^{32}$, $R^{33}$, and $R^{34}$ include those which are described above as the substituent groups on the rings formed from Q and $C_\alpha$. Examples of preferred pyrrolotriazole type couplers represented by formulas (9) to (12) include couplers in which at least one of $R^{32}$ and $R^{33}$ is an electron attractive group, as described in European Patents 488,248A1, 491,197A1, and 545,300. Y has the same meanings as above.

In addition, couplers having structures such as a condensed-ring phenol, an imidazole, a pyrrole, a 3-hydroxypyridine, the other active methylenes, an active methine, a 5,5-condensed-ring heterocycle, and a 5,6-condensed-ring heterocycle can be used.

Usable condensed-ring phenol type couplers include those which are described in U.S. Pat. Nos. 4,327,173, 4,564,586, 4,904,575, etc.

Usable imidazole type couplers include those which are described in U.S. Pat. Nos. 4,818,672, 5,051,347, etc.

Usable 3-hydroxypyridine type couplers include those which are described in JP-A-1-315736, etc.

Usable active methylene and active methine couplers include those which are described in U.S. Pat. Nos. 5,104, 783, 5,162,196, etc.

Usable 5,5-condensed-ring heterocycle type couplers include pyrrolopyrazole type couplers described in U.S. Pat. No. 5,164,289 and pyrroloimidazole type couplers described in JP-A-4-174429.

Usable 5,6-condensed-ring heterocycle type couplers include pyrazolopyrimidine type couplers described in U.S. Pat. No. 4,950,585, pyrrolotriazine type couplers described in JP-A-4-204730, and couplers described in European Patent 556,700.

In addition to the couplers described above, couplers usable in the present invention include those which are described in West German Patents 3,819,051A and 3,823, 049, U.S. Pat. Nos. 4,840,883, 5,024,930, 5,051,347, and 4,481,268, European Patents 304,856A2, 329,036, 354, 549A2, 374,781A2, 379,110A2, and 386,930A1, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731, JP-A-4-204732, etc.

In the couplers used in the present invention, the total numbers of carbon atoms of the moieties except Y are preferably from 1 to 30, more preferably from 1 to 24, and most preferably from 1 to 18.

Examples of the couplers usable in the present invention are shown below, but it is a matter of course that the present invention is not limited by these examples.

(C-1)

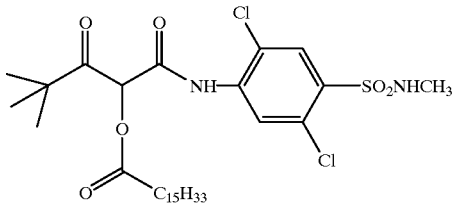

(C-2)

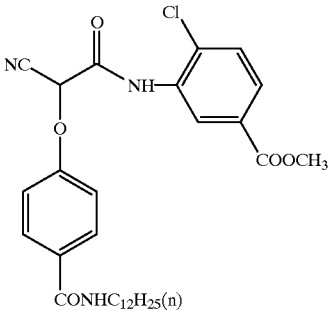

(C-3)

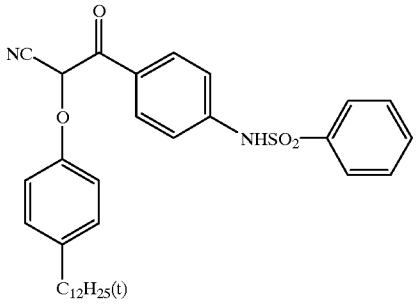

-continued
(C-4)
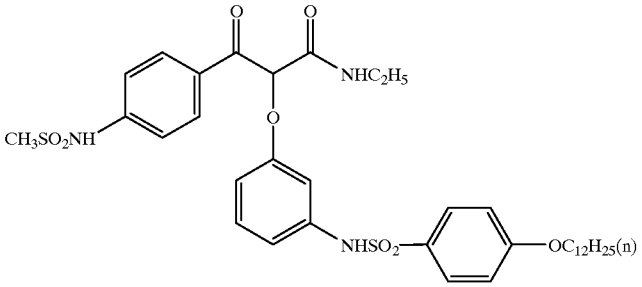
(C-5)
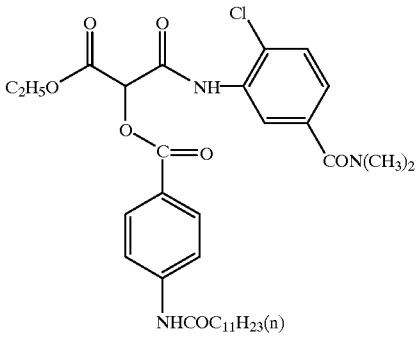
(C-6)
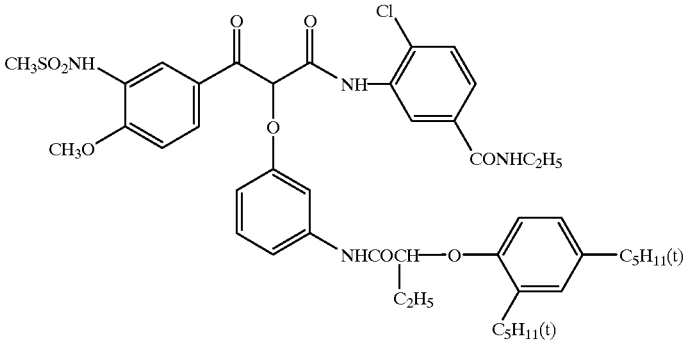
(C-7)
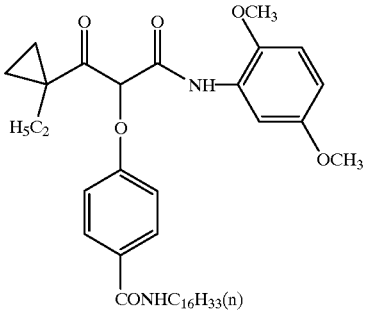

-continued
(C-8)
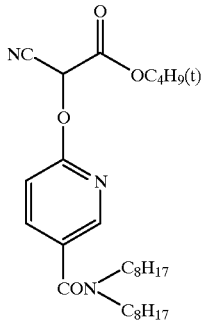
(C-9)
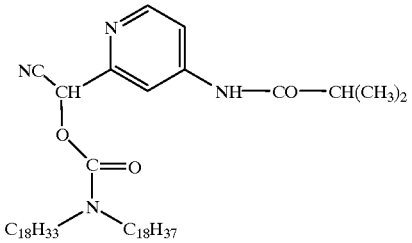
(C-10)
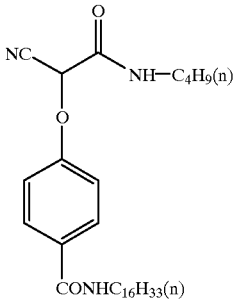
(C-11)
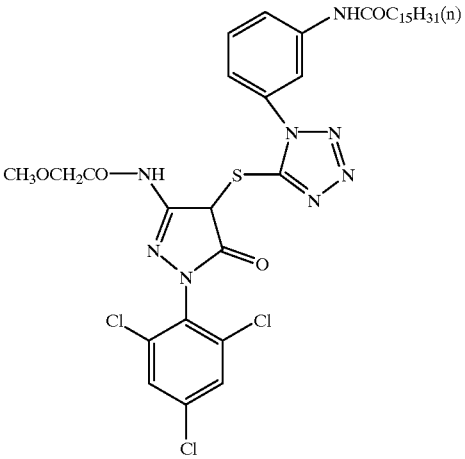

-continued
(C-12)
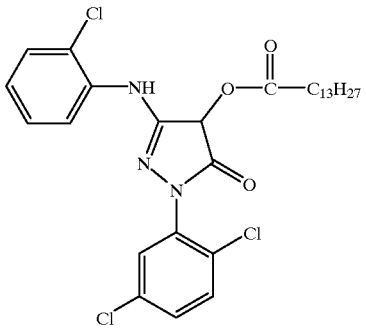
(C-13)
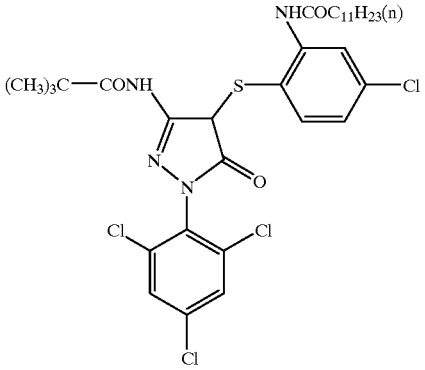
(C-14)
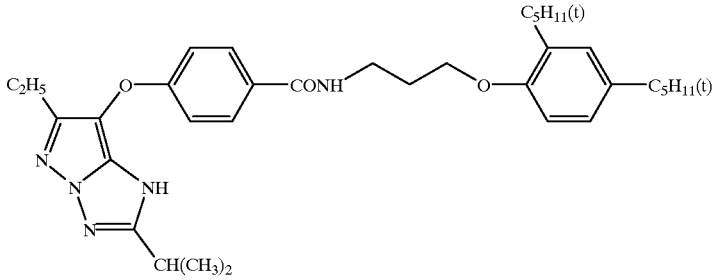
(C-15)
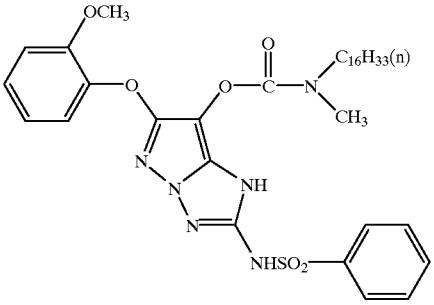
(C-16)
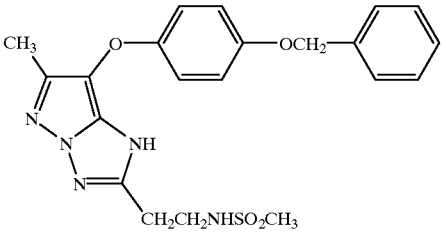

-continued
(C-17)
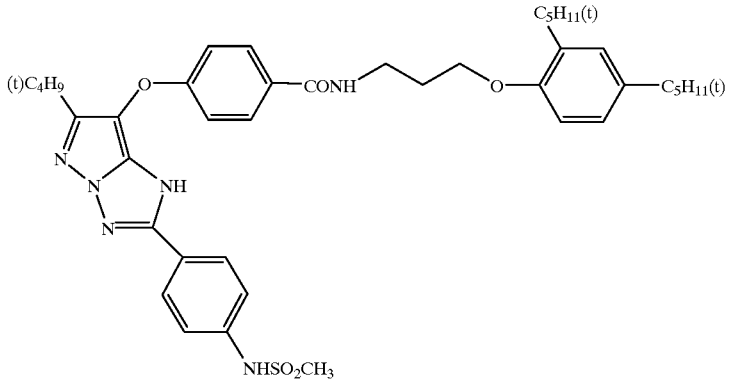
(C-18)
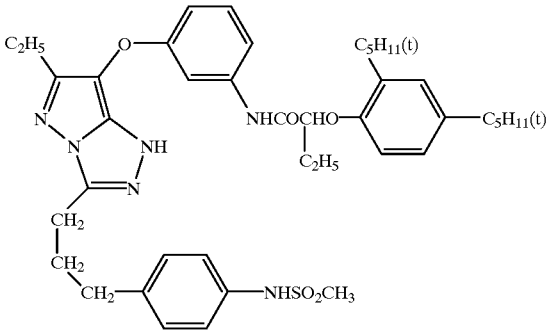
(C-19)
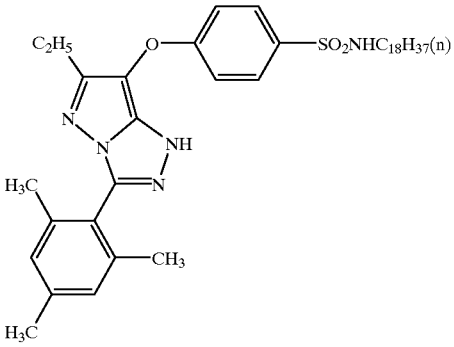
(C-20)
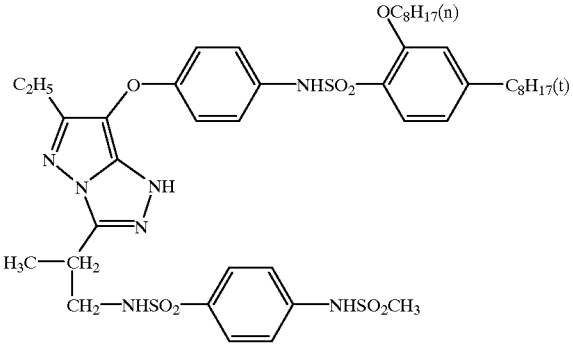

-continued
(C-21)
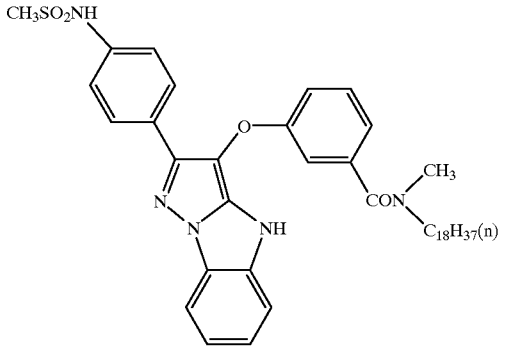
(C-22)
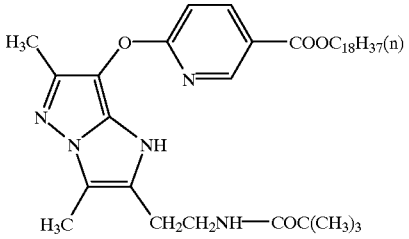
(C-23)
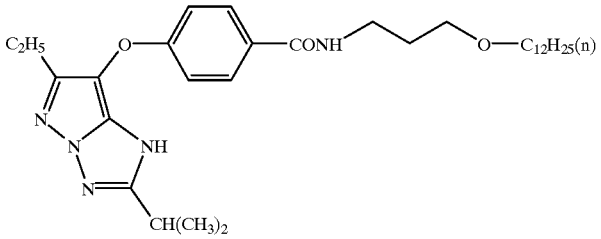
(C-24)
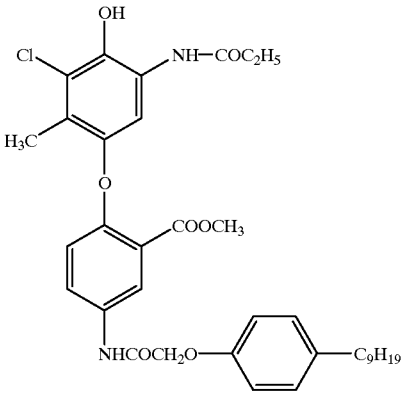
(C-25)
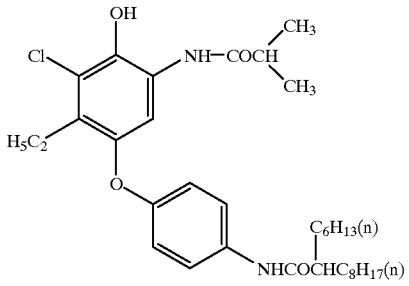

-continued
(C-26)
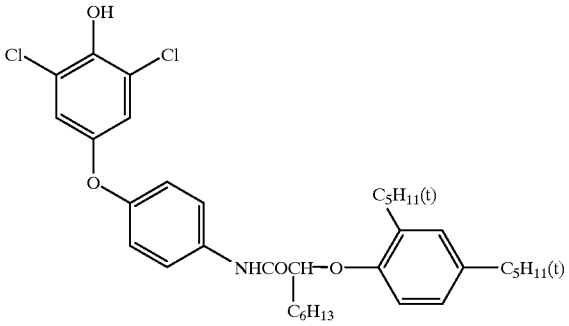
(C-27)
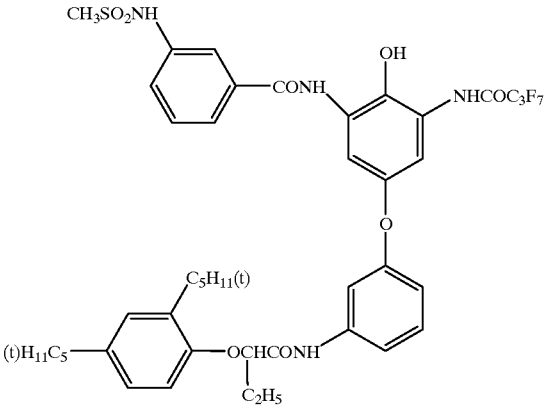
(C-28)
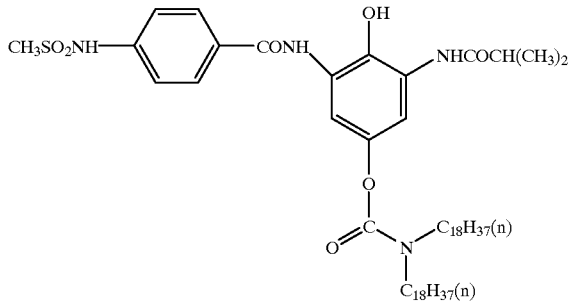
(C-29)
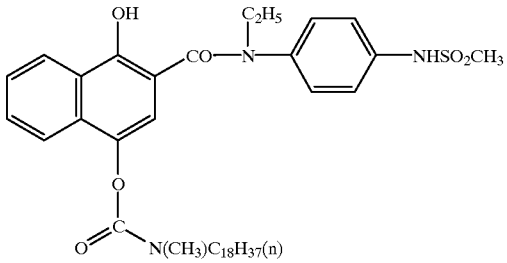

-continued
(C-30)
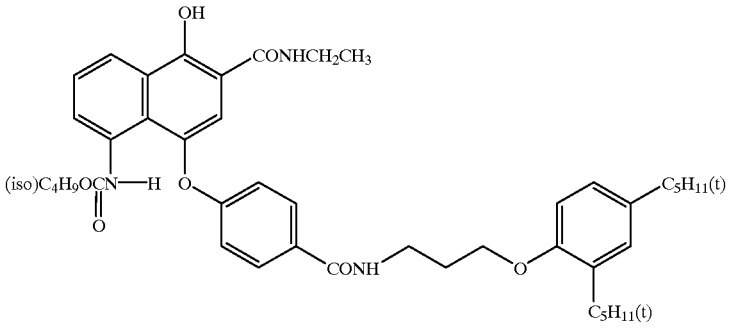
(C-31)
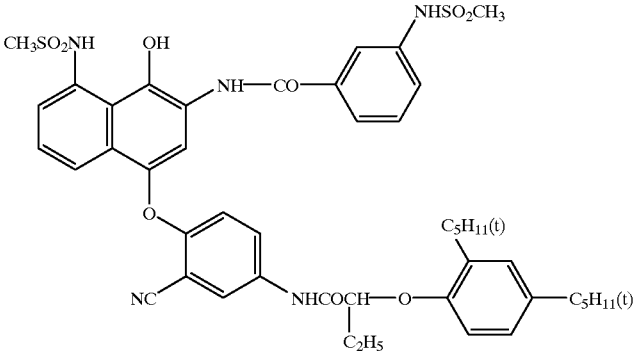
(C-32)
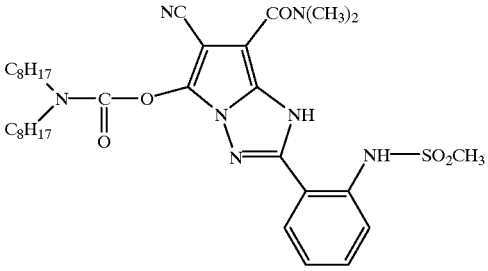
(C-33)
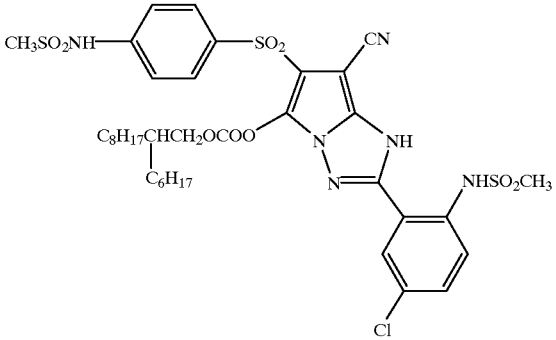

-continued
(C-34)
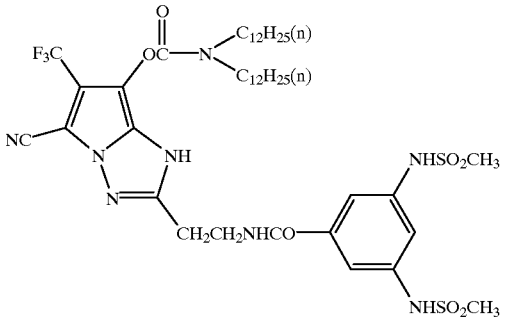
(C-35)
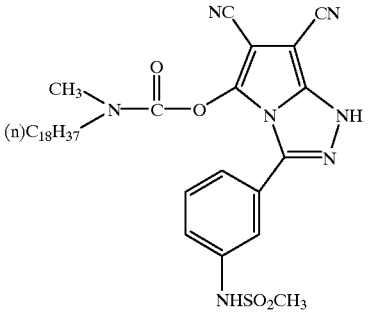
(C-36)
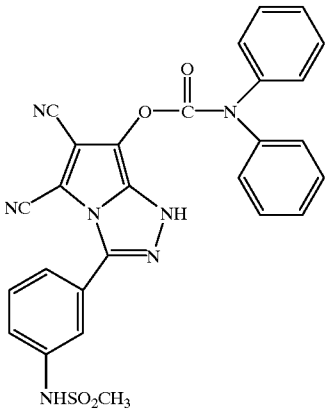
(C-37)
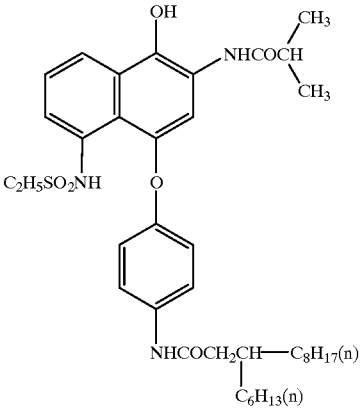

-continued
(C-38)
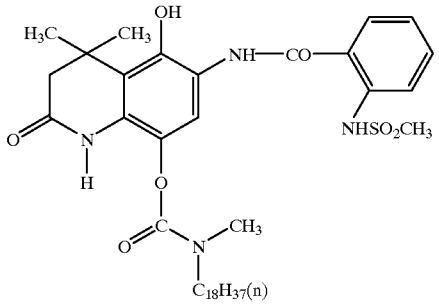
(C-39)
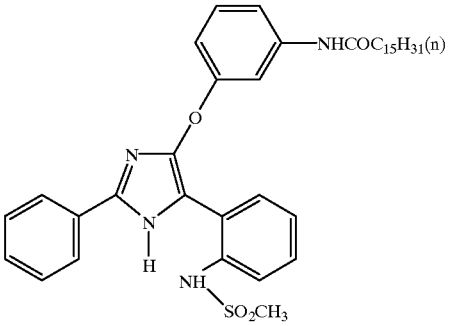
(C-40)
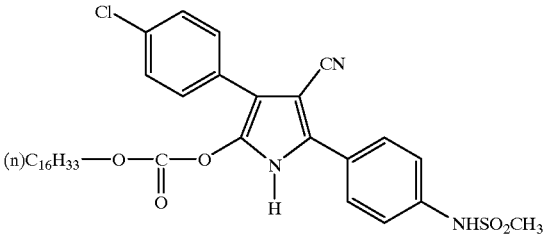
(C-41)
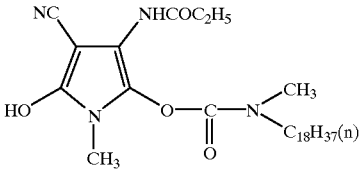
(C-42)
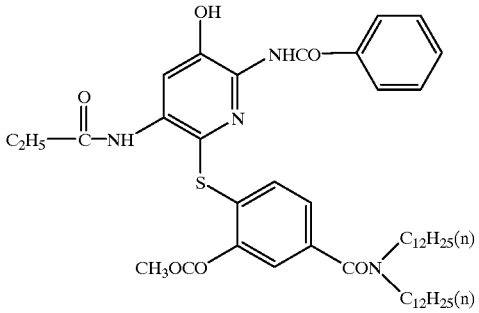

-continued
(C-43)
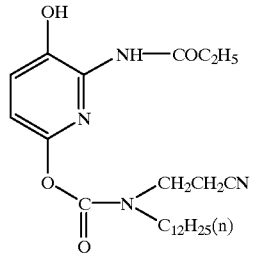
(C-44)
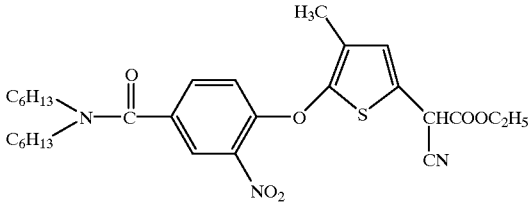
(C-45)
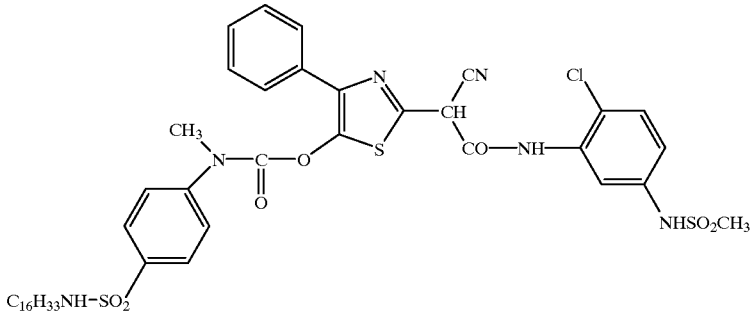
(C-46)
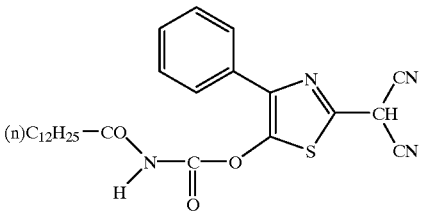
(C-47)
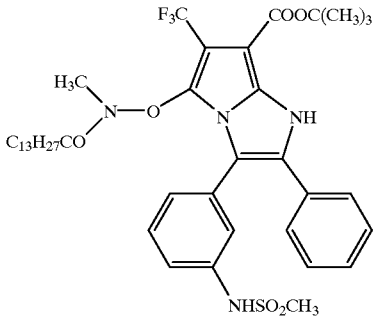

-continued (C-48)

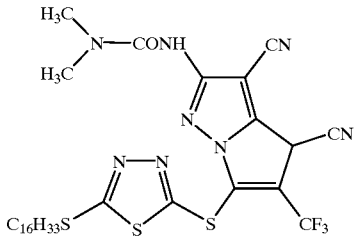

(C-49)

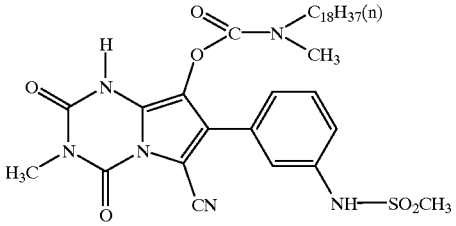

(C-50)

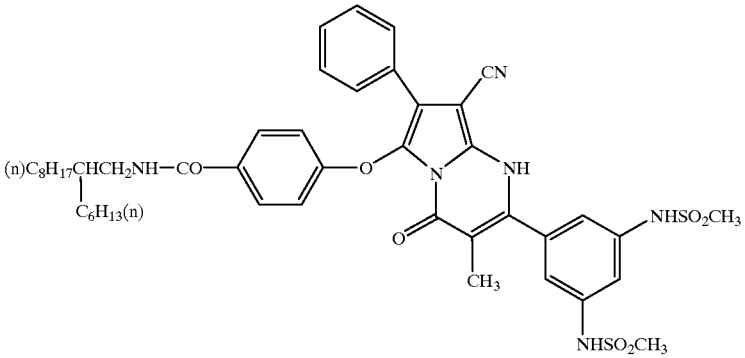

Although the amounts of the couplers used in the present invention are dependent upon molar absorption coefficients (E) of dyes formed therefrom, when the coefficients of the dyes formed by the coupling reaction are from about 5000 to about 500,000, the coating amounts required to obtain image densities of 1.0 or more in reflection density are from about 0.001 to about 100 mmole/$m^2$, preferably from about 0.01 to about 10 mmole/$m^2$, and most preferably from about 0.05 to about 5 mmole/$m^2$.

The mole amounts of the color developing agents used in the present invention are from 0.01 to 100 times those of the couplers, preferably from 0.1 to 10 times, and more preferably from 0.2 to 5 times.

In the present invention, it is preferred to use auxiliary developing agents. The auxiliary developing agents herein mean substances which accelerate the electron transfer from the color developing agents to silver halides in a development step of the silver halides. The auxiliary developing agents used in the present invention are preferably electron-releasing compounds following Kendahl-Perz's rule, which are represented by formulas (B-1) and (B-2). Of these compounds, those represented by formula (B-1) are particularly preferred.

Formula (B-1)

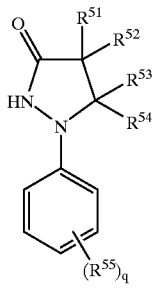

Formula (B-2)

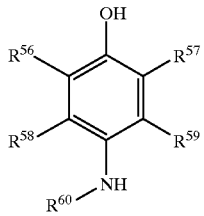

In formulas (B-1) and (B-2), $R^{51}$ to $R^{54}$ each represent a hydrogen atom, an alkyl group, a cycloalkyl group, an alkenyl group, an aryl group, or a heterocyclic group.

$R^{55}$ to $R^{59}$ each represent a hydrogen atom, a halogen atom, a cyano group, an alkyl group, a cycloalkyl group, an alkenyl group, an aryl group, a heterocyclic group, an alkoxy group, a cycloalkyloxy group, an aryloxy group, a heterocycle-oxy group, a silyloxy group, an acyloxy group, an amino group, an anilino group, a heterocycle-amino group, an alkylthio group, an arylthio group, a heterocycle-thio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino group, a sulfonamido group, a sulfamoylamino group, an alkylsulfinyl group, arenesulfinyl group, an alkanesulfonyl group, an arenesulfonyl group, a sulfamoyl group, a sulfo group, a phosphinoyl group, or a phosphinoylamino group.

q represents an integer of 0 to 5, and when q is 2 or more, $R^{55}$s may be different from one another. $R^{60}$ represents an alkyl group or an aryl group.

Examples of the compounds represented by formulas (B-1) and (B-2) are shown below, but auxiliary developing agents used in the present invention are not limited to these examples.

(ETA-1)

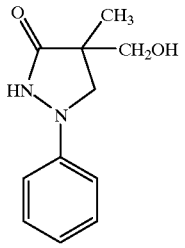

(ETA-2)

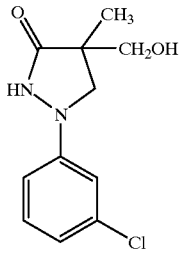

(ETA-3)

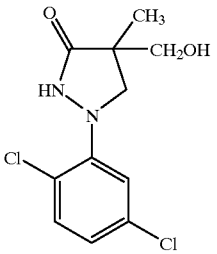

-continued (ETA-4)

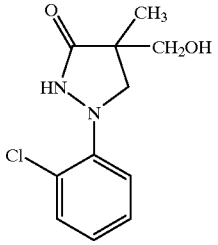

(ETA-5)

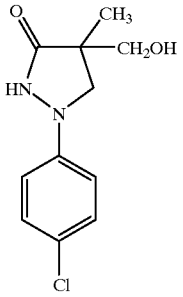

(ETA-6)

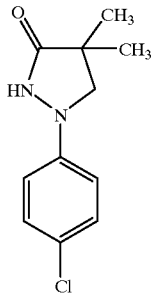

(ETA-7)

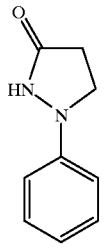

-continued
(ETA-8)
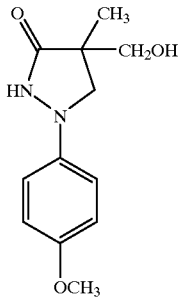
(ETA-9)
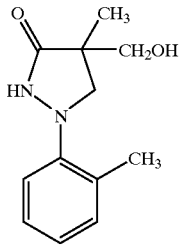
(ETA-10)
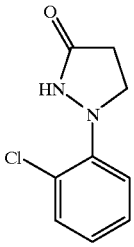
(ETA-11)
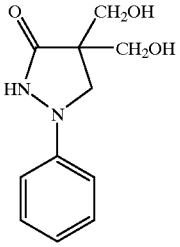
(ETA-12)
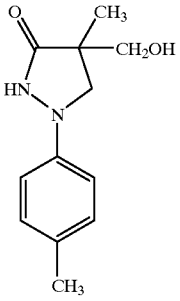
-continued
(ETA-13)
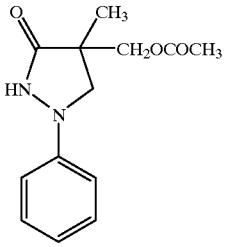
(ETA-14)
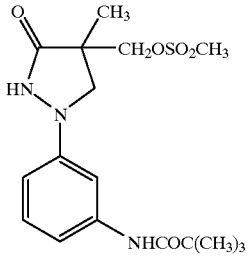
(ETA-15)
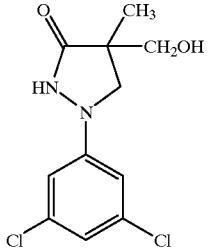
(ETA-16)
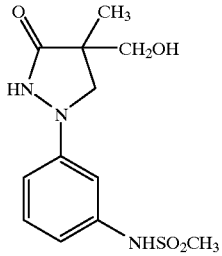
(ETA-17)
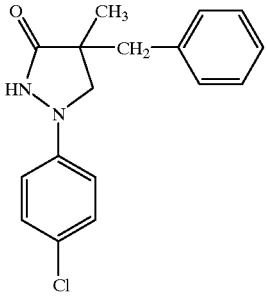

-continued
(ETA-18)
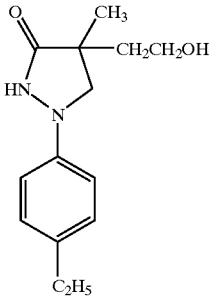
(ETA-19)
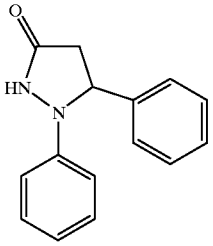
(ETA-20)
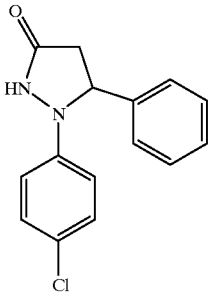
(ETA-21)
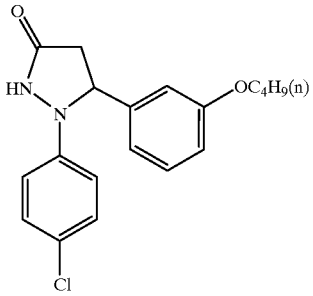
(ETA-22)
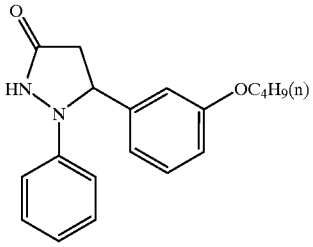
-continued
(ETA-23)
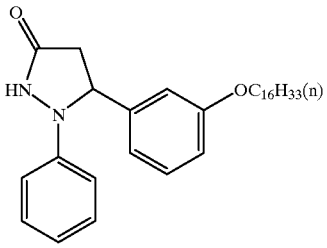
(ETA-24)
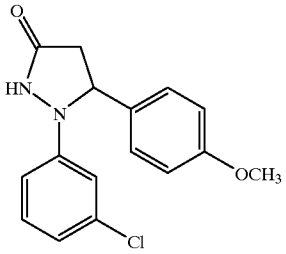
(ETA-25)
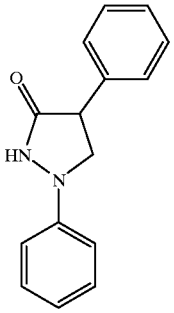
(ETA-26)
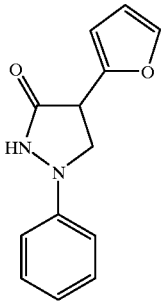
(ETA-27)
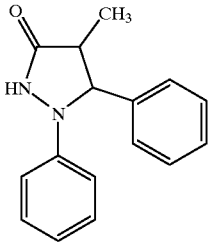

-continued (ETA-28)

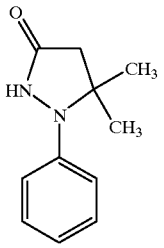

(ETA-29)

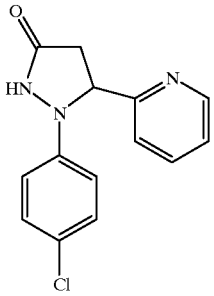

(ETA-30)

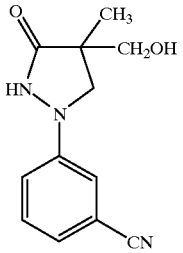

(ETA-31)

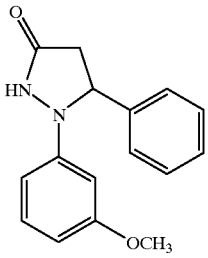

(ETA-32)

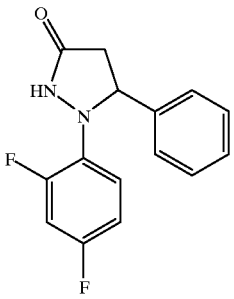

-continued (ETA-33)

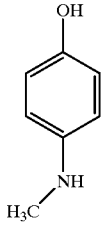

(ETA-34)

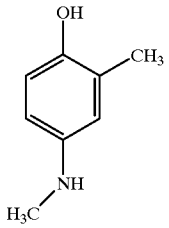

(ETA-35)

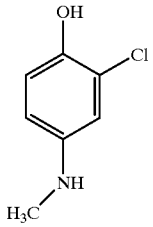

(ETA-36)

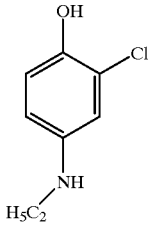

In the present invention, blocked photographic agents represented by formula (A) from which photographically useful groups can be released on processing can be used.

$$A\text{-}(L)_n\text{-}PUG \qquad (A)$$

wherein A represents a blocking group which is released on processing by $A\text{-}(L)_n$ bond cleavage; L represents a connecting group in which $(L)_n$-PUG bond cleavage follows $A\text{-}(L)_n$ bond cleavage; n represents an integer of 0 to 3; and PUG represents a photographically useful group.

The groups in formula (A) are described below.

The following known blocking groups can be employed as the blocking groups represented by A: blocking groups such as an acyl group and a sulfonyl group as described in JP-B-48-9968, JP-A-52-8828, JP-A-57-82834, U.S. Pat. No. 3,311,476, JP-B-47-44805 (U.S. Pat. No. 3,615,617), etc.; blocking agents utilizing the reverse Michael reaction as described in JP-B-55-17369 (U.S. Pat. No. 3,888,677), JP-B-55-9696 (U.S. Pat. No. 3,791,830), JP-B-55-34927

(U.S. Pat. No. 4,009,029), JP-A-56-77842 (U.S. Pat. No. 4,307,175), JP-A-59-105640, JP-A-59-105641, JP-A-59-105642, etc.; blocking groups utilizing formation of quinonemethide or compounds analogous to quinonemethide by intramolecular electron transfer as described in JP-B-54-39727, U.S. Pat. Nos. 3,674,478, 3,932,480 and 3,993,661, JP-A-57-135944, JP-A-57-135945 (U.S. Pat. No. 4,420,554), JP-A-57-136640, JP-A-61-196239, JP-A-61-196240 (U.S. Pat. No. 4,702,999), JP-A-61-185743, JP-A-61-124941 (U.S. Pat. No. 4,639,408), JP-A-2-280140, etc.; blocking groups utilizing an intramolecular nucleophilic displacement reaction as described in U.S. Pat. Nos. 4,358,525, 4,330,617, JP-A-55-53330 (U.S. Pat. No. 4,310,612), JP-A-59-121328, JP-A-59-218439, JP-A-63-318555 (European Patent Publication No.0295729), etc.; blocking groups utilizing ring cleavage of 5- or 6-membered rings as described in JP-A-57-76541 (U.S. Pat. No. 4,335,200), JP-A-57-135949 (U.S. Pat. No. 4,350,752), JP-A-57-179842, JP-A-59-137945, JP-A-59-140445, JP-A-59-219741, JP-A-59-202459, JP-A-60-41034 (U.S. Pat. No. 4,618,563), JP-A-62-59945 (U.S. Pat. No. 4,888,268), JP-A-62-65039 (U.S. Pat. No. 4,772,537), JP-A-62-80647, JP-A-3-236047, JP-A-3-238445, etc.; blocking groups utilizing an addition reaction of nucleophiles to conjugated unsaturated bond systems as described in JP-A-59-201057 (U.S. Pat. No. 4,518,685), JP-A-61-95346 (U.S. Pat. No. 4,690,885), JP-A-61-95347 (U.S. Pat. No. 4,892,811), JP-A-64-7035, JP-A-64-42650 (U.S. Pat. No. 5,066,573), JP-A-1-245255, JP-A-2-207249, JP-A-2-235055 (U.S. Pat. No. 5,118,596), JP-A-4-186344, etc.; blocking groups utilizing a β-elimination reaction as described in JP-A-59-93442, JP-A-61-32839, JP-A-62-163051, JP-B-5-37299, etc.; blocking groups utilizing a nucleophilic displacement reaction of diarylmethanes as described in JP-A-61-188540; blocking groups utilizing a Lossen rearrangement as described in JP-A-62-187850; blocking groups utilizing a reaction of N-acyl derivatives of thiazolidine-2-thione with amines as described in JP-A-62-80646, JP-A-62-144163 and JP-A-62-147457; blocking groups which each have two electrophilic groups and are allowed to react with two nucleophiles as described in JP-A-2-296240 (U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, JP-A-4-184338, PCT International publication No.92/21064, JP-A-4-330438, PCT International Publication No.93/03419, and JP-A-5-45816; and blocking groups described in JP-A-3-236047 and JP-A-3-238445.

In the compounds represented by formula (A), any connecting groups in which $(L)_{n-1}$-PUG bond cleavage can occur after the groups represented by A are released on processing can be used as groups represented by L. Examples of the groups represented by L include groups utilizing hemiacetal ring cleavage as described in U.S. Pat. Nos. 4,146,396, 4,652,516 and 4,698,297; timing groups inducing an intramolecular nucleophilic displacement reaction as described in U.S. Pat. Nos. 4,248,962, 4,847,185 and 4,857,440; timing groups inducing a cleavage reaction by utilizing an electron transfer reaction as described in U.S. Pat. Nos. 4,409,323 and 4,421,845; groups inducing a cleavage reaction by utilizing a hydrolytic reaction of iminoketals as described in U.S. Pat. No. 4,546,073; groups inducing a cleavage reaction by utilizing a hydrolytic reaction of esters as described in West German Patent (OLS) 2,626,317; and groups inducing a cleavage reaction by utilizing a reaction with sulfite ion as described in European Patent 0572084.

PUG in formula (A) represents an photographically useful groups such as development inhibitors, photographic dyes, the above-mentioned auxiliary developing agents, reducing agents such as development accelerators, or discoloration preventives.

Although the amounts of color developing agents and couplers used in the present invention each can vary in the wide range, they usually range from 0.01 to 4 moles per mole of silver, respectively.

Hydrophobic additives used in the present invention, such as color developing agents, couplers or image formation accelerators described below, can be incorporated into the layers of photographic materials by known methods such as a method described in U.S. Pat. No. 2,322,027. The color developing agents and couplers may be separately added to different layers. However, it is preferred that they are added to the same layer, and in this case, they are preferably incorporated into silver halide emulsion layers. The auxiliary developing agents may be added to any of photographic constituent layers, but they are preferably added to layers adjacent to the silver halide emulsion layers, such as interlayers or protective layers. To introduce these compounds to the photographic constituent layers, high boiling organic solvents described in JP-A-59-83154, JP-A-59-178451, JP-A-59-178452, JP-A-59-178453, JP-A-59-178454, JP-A-59-178455, JP-A-59-178457, etc. can be used, as needed, together with low boiling organic solvents having boiling points of 50 to 160° C.

The amounts of the high boiling organic solvents are 10 g or less, and preferably 5 g or less per g of the combined amounts of the color developing agents and couplers used.

A dispersion process using polymers as described in JP-B-51-39853 and JP-A-51-59943 is also usable.

In the case of substantially water-insoluble compounds, a process of dispersing them into binders as fine particles and adding to the layers can also be used, as well as the processes described above.

Various surfactants can be used to disperse the hydrophobic substances into hydrophilic colloid solutions. For example, surfactants described in JP-A-59-157636, pages 37 and 38, can be used for this purpose.

The color developing agents and couplers of the present invention can be used for photosensitive elements for color diffusion transfer process, which can be developed at about room temperature by use of processing solutions, and in addition, for heat development photosensitive elements which are developed by heating.

Silver halides usable for the photosensitive elements described above may be any of silver chloride, silver bromide, silver chlorobromide, silver chloroiodide, and silver chloroiodobromide.

Specifically, any of silver halide emulsions described in U.S. Pat. No. 4,500,626 (column 50), *Research Disclosure*, June, 1978, pages 9 and 10 (RD17029), JP-A-61-107240, JP-A-62-85241, JP-A-62-87957, etc. can be used.

The silver halide emulsions used in the present invention may be either of a surface latent image type in which latent images are mainly formed on the surfaces of grains or of a internal latent image type in which latent images are formed inside grains. Further, the so-called core/shell emulsions which have different layers inside grains and on the surfaces of the grains can also be used. Furthermore, direct reversal emulsions in which internal latent image type emulsions and nucleating agents and/or light reversal agents are joined can also be used in the present invention.

Although the silver halide emulsions may be used in a un-afterripening state, they are usually subjected to chemical sensitization prior to use. Sulfur sensitization, reduction sensitization, noble metal sensitization, or the like, which are known to conventional photosensitive material emulsions, can be performed, singly or in combination. These methods of sensitization can be applied in the presence of nitrogen-containing heterocycles (JP-A-58-126526 and JP-A-58-215644). The coating amounts of photosensitive silver halides in the present invention range from 1 mg to 10 g/m$^2$ in terms of silver.

The silver halides used in the present invention can be subjected to spectral sensitization by use of methine dyes or the like. Dyes used for this purpose include cyanine dyes, merocyanine dyes, complex cyanine dyes, complex merocyanine dyes, holopolar cyanine dyes, hemicyanine dyes, styryl dyes, and hemioxonol dyes. Specifically, heat-decolorant sensitizing dyes are used, which are described in JP-A-59-180550, JP-A-60-140335, *Research Disclosure*, June, 1978, pages 12 and 13 (RD-17029), etc.

In the photosensitive materials of the present invention, the above-mentioned couplers forming yellow, magenta and cyan colors are used together with the compounds represented by formula (I). Combinations of two or more of known couplers can be used as the couplers of the present invention.

Further, the color developing agents and couplers of the present invention can be used in the same photographic element in combination with known dye donative compounds such as dye developing agents described later or compounds from which diffusible dyes are released by a redox reaction. For example, it also is possible that image formation of yellow and cyan colors is performed by use of the color developing agents and couplers of the present invention, whereas image formation of a magenta color is performed by use of other dye image formation compounds.

The dye image formation compounds used simultaneously in the present invention, first, include combinations of known developing agents with couplers which can react with them. In the system utilizing these couplers, dye formation is carried out by reaction of the couplers with the oxidation products of developing agents which are yielded by the oxidation-reduction reaction between silver salts and developing agents, and examples of the system are described in a number of literature. The couplers may be either four equivalent couplers or two equivalent couplers. Two equivalent couplers which contain nondiffusive groups as releasing groups and form diffusible dyes by reacting with the oxidation products of developing agents are also preferred. Examples of the developing agents and couplers are described in detail in T. H. James, *The Theory of the Photographic Process*, 4th edition, pp.291–334 and pp.354–361, JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, etc.

Further, dye silver compounds in which organic silver salts are binded with dyes can also be included in the examples of the dye image formation compounds. Examples of the dye silver compounds are described in *Research Disclosure*, May, 1978, pp.54–58 (RD-16966), etc.

Furthermore, azo dyes used in a heat development silver dye bleaching process can also be included in the examples of the dye image formation compounds. Examples of the azo dyes and processes for bleaching are described in U.S. Pat. No. 4,235,957, *Research Disclosure, April,* 1976, pp.30–32 (RD-14433), etc. Leuco dyes described in U.S. Pat. Nos. 3,985,565 and 4,022,617 can also be included in the examples of the dye donative substances.

Compounds having a function to release or diffuse diffusible dyes in image shapes can be added as the example of another type of dye image formation compounds.

Compounds of this type can be represented by the following formula [LI]:

$$(\text{Dye-X})_n\text{-Y} \qquad [\text{LI}]$$

wherein Dye represents a known dye group, or a dye group or a dye precursor whose absorption spectrum is temporarily shifted to shorter wavelengths; X represents a mere bond or a connecting group; Y represents a group having a nature that difference in diffusibility arises among compounds represented by $(\text{Dye-X})_n$-Y, or Dye is released from $(\text{Dye-X})_n$-Y and difference in diffusibility arises between Dye and $(\text{Dye-X})_n$-Y, corresponding to or reversely corresponding to sensitive silver salts having latent images formed in image shape; and n represents 1 or 2, and when n is 2, two (Dye-X)s may be the same or different from each other.

Examples of the dye donative substances represented by formula [LI] include dye developing agents in which hydroquinone type developing agents are linked to dye components as described in U.S. Pat. Nos. 3,134,764, 3,362,819, 3,597,200, 3,544,545, 3,482,972, etc. Further, substances from which diffusible dyes are released by an intramolecular nucleophilic displacement reaction are described in JP-A-51-63618, etc., and substances from which diffusible dyes are released by an intramolecular ring-transformation reaction of an isoxazolone ring are described in JP-A-49-111628, etc. In these systems, diffusible dyes are released or diffused in portions which do not undergo development, and no dyes are released or diffused in portions which undergo development.

Further, one of the other systems is designed so that dye releasing compounds of oxidation product type which themselves have no ability to release dyes are allowed to coexist with reducing agents or precursors thereof, and after development, the dye releasing compounds are reduced by the reducing agents left without undergoing oxidation to release diffusible dyes. Examples of the dye image formation compounds used in this system are described in JP-A-53-110827, JP-A-54-130927, JP-A-56-164342, and JP-A-53-35533.

On the other hand, substances from which the dyes are released in portions which undergo development, that is, substances from which the diffusible dyes are released by a reaction of couplers containing the diffusible dyes as releasing groups with the oxidation products of developing agents are described in British Pat. No. 1,330,524, JP-B-48-39165, U.S. Pat. No. 3,443,940, etc.

The system using these color developing agents has a serious disadvantage of image stains due to oxidative decomposition products from developing agents. To solve this problem, dye releasing compounds themselves having reducibility without requiring developing agents are also designed. Typical examples thereof include dye image formation compounds described in U.S. Pat. Nos. 3,928,312, 4,053,312, 4,055,428, and 4,336,322, JP-A-59-65839, JP-A-59-69839, JP-A-51-104343, *Research Disclosure* (17465), U.S. Pat. Nos. 3,725,062, 3,728,113, and 3,443,939, JP-A-58-116537, JP-A-57-179840, U.S. Pat. No. 4,500,626, etc.

The system of forming images by diffusion transfer of dyes to which the photosensitive materials of the present invention are applied can be classified into two forms, that is, a form in which a photosensitive element and an image receiving element (dye fixing element) are separately provided on two different supports to form a photosensitive material, and another form in which both the elements are provided on a single support.

As to relation between the photosensitive element and dye fixing element, relation of the elements with a support, and relation of the elements with a white reflection layer, the corresponding relation described in JP-A-61-147244 (pages 58 and 59) and U.S. Pat. No. 4,500,626 (column 57) can be applied to the photosensitive materials of the present invention.

In a typical form of a film unit in which the photosensitive element and image receiving element (dye fixing element) are provided on a single support, both the elements are laminated on a transparent support and need no separation after image transfer. More specifically, the image receiving element comprises at least one mordant layer, and the photosensitive element is, in its preferred form, constituted of a combination of a blue sensitive emulsion layer, a green sensitive emulsion layer and a red sensitive emulsion layer, a combination of a green sensitive emulsion layer, a red sensitive emulsion layer and an infrared sensitive emulsion layer, or a combination of a blue sensitive emulsion layer, a red sensitive emulsion layer and an infrared sensitive emulsion layer. In each of these emulsion layers, yellow dye image formation compounds (dye image formation compounds containing the color developing agents and couplers of the present invention), magenta dye image formation compounds (dye image formation compounds containing the color developing agents and couplers of the present invention), and cyan dye image formation compounds (dye image formation compounds containing the color developing agents and couplers of the present invention) are employed in combination. (The "infrared sensitive emulsion layer" herein means an emulsion exhibiting sensitivity to light in the wavelength region of 700 nm or more, particularly 740 nm or more.). Each of the photosensitive emulsion layers may be constituted of two or more layers, as needed. White reflection layers containing a solid pigment such as titanium oxide are provided between said mordant layers and the photosensitive layers or layers containing the dye image formation compounds (dye image formation compounds containing color developing agents and couplers of the present invention) to observe transfer images through a transparent support. Light-shielding layers may be provided between the white reflection layers and the photosensitive layers so that processing can be carried out in a lighted room. Further, a peel layer may be provided, if desired, in an appropriate position to make it possible to separate all photosensitive elements or part thereof from the image receiving element (Such embodiment is described in JP-A-56-67840 and Canadian Pat. No. 674,082).

In another form needing no separation, the above-mentioned photosensitive elements are provided on a transparent support, and a white reflection layer is provided on the photosensitive elements, and an image receiving layer is further laminated to the white reflection layer. A form in which an image receiving element, a white reflection layer, a peel layer, and photosensitive elements are laminated to a single support and the photosensitive elements are intendedly separated from the image receiving element is described in U.S. Pat. No. 3,730,718. On the other hand, a typical form in which the photosensitive elements and the image receiving element are separately provided on two different supports is classified into two large types, a separation type and a type needing no separation. These types are described in detail below. In preferred embodiment of a separation type film unit, a light reflection layer is provided on the backside of a support, and at least one image receiving layer is provided on the front surface of the support. Photosensitive elements are provided on the side having the light shielding layer, and the surface of the photosensitive layer and the surface of the mordant layer do not face each other before completing exposure. However, the film unit is designed so that the surface of the photosensitive layer is turned after completing exposure (for example, during processing) to face the surface of the image receiving layer. After image transfer is accomplished in the mordant layer, the photosensitive elements are rapidly separated from the image receiving element.

In preferred embodiment of a film unit of the type needing no separation, at least one mordant layer is provided on a transparent support, photosensitive elements are provided on another transparent support or a support having a light shielding layer, and both the surfaces of the photosensitive layers and the mordant layer are superposed, facing each other.

Any of the above-mentioned forms can be applied either to a system developed with an alkali processing solution or to a heat development system, and the former system may be combined with a vessel containing the alkali processing solution, the vessel rupturing under pressure (a processing element). Particularly, in the film unit of the type needing no separation in which an image receiving element is laminated to photosensitive elements on a single support, this processing element is preferably placed between the photosensitive elements and a cover sheet superposed thereon. In the form in which the photosensitive elements and image receiving element are separately provided on two different supports, the processing element is preferably placed between the photosensitive elements and the image receiving element during processing at the latest. The processing element is preferably contain a light-shielding agent (carbon black or dyes whose colors are altered by pH, etc.) and/or a white pigment (titanium oxide, etc.) according to the forms of film units. Further, in the film unit of the system in which development is performed with the alkali processing solution, a neutralizing timing mechanism constituted of a combination of a neutralizing layer and a neutralizing timing layer is preferably incorporated into the cover sheet, the image receiving element, or the photosensitive elements.

Mordants used for the image receiving element described above and a dye fixing element described later are preferably polymer mordants. The polymer mordants used herein include polymers having tertiary amino groups, polymers having nitrogen-containing heterocyclic moieties, polymers having quaternary cationic groups, and the like. Examples thereof are described in JP-A-61-147244, pp. 98–100 and U.S. Pat. No. 4,500,626, column 57 to 60.

When the present invention is applied to a heat development photosensitive material, organic metallic salts can be used as oxidizing agents together with silver halides. In this case, it is necessary that organic metallic salts are in contact with or in close distance from the photosensitive silver halides. Of such organic metallic salts, organic silver salts are particularly preferably used.

Organic compounds used for forming the organic silver salt oxidizing agents include those which are described in JP-A-61-107240 (pp.37–39), U.S. Pat. No. 4,500,626 (columns 52 and 53), etc. Further, silver salts of carboxylic acids containing an alkynyl group such as silver phenylpropiolate described in JP-A-60-113235 and silver acetylides described in JP-A-61-249044 also are useful. Two or more organic silver salts may be simultaneously used.

These organic silver salts are used in amounts of from 0.01 to 10 moles, and preferably from 0.01 to 1 mole per mole of photosensitive silver halides. The total coating amounts of the photosensitive silver halides and organic silver salts are suitably from 50 mg to 10 g/m$^2$ in terms of silver.

Of the above-mentioned additives, hydrophobic additives can be introduced into the layers of the photosensitive materials by known procedures such as that described in U.S. Pat. No. 2,322,027. In this case, high boiling organic solvents as described in JP-A-59-83154, JP-A-59-178451, JP-A-59-178452, JP-A-59-178453, JP-A-59-178454, JP-A-59-178455, JP-A-59-178457, etc. can be used together with low boiling organic solvents having boiling points of 50 to 160° C., as needed.

A procedure for dispersing with the aid of polymers can also be used for this purpose, which are described in JP-B-51-39853 and JP-A-51-59943.

For substantially water-insoluble compounds, there is a procedure of dispersing them into binders as fine particles, in addition to the above-mentioned procedures.

Various surfactants can be used to disperse the hydrophobic substances into hydrophilic colloid solutions. For examples, surfactants described in JP-A-59-157636 (pages 37 and 38) can be used for this purpose.

In the present invention, reductive substances can be preferably added to the photosensitive elements. In addition to known reducing agents, the reductive substances include the above-mentioned dye image formation compounds containing the reductive color developing agents of the present invention. Further, precursors of reducing agents which themselves have no reducibility but come to exhibit reducibility by the action of nucleophilic agents or heat during processing also are included therein. Examples of the reducing agents used in the present invention include those which are described in U.S. Pat. No. 4,500,626 (columns 49 and 50) and 4,483,914 (columns 30 and 31), JP-A-60-140335 (pages 17 and 18), JP-A-60-128438, JP-A-60-128436, JP-A-60-128439, JP-A-60-128437, etc. Precursors of reducing agents described in JP-A-56-138736, JP-A-57-40245, U.S. Pat. No. 4,330,617, etc. can also be used.

Combinations of various reducing agents as disclosed in U.S. Pat. No. 3,039,869 also are usable.

In the present invention, the amounts of these reducing agents to be added are from 0.01 to 20 moles, and particularly preferably from 0.1 to 10 moles per mole of silver.

In the present invention, compounds which contribute to the stabilization of images in addition to the activation of development can be incorporated into the photosensitive elements. Examples of those compounds used preferably are described in U.S. Pat. No. 4,500,626 (columns 51 and 52).

In the present invention, various antifoggants and photographic stabilizing agents can be used. Examples thereof include azoles and azaindenes described in *Research Disclosure*, December, 1978, pages 24 and 25; nitrogen-containing carboxylic acids and phosphoric acids described in JP-A-59-168442; mercapto compounds and metallic salts thereof described in JP-A-59-111636; and acetylene compounds described in JP-A-62-87957.

In the present invention, image toning agents can be incorporated into the photosensitive elements as needed. Examples of useful image toning agents are described in JP-A-61-147244, pages 92 and 93.

The photosensitive elements used in the present invention can contain various additives usually used for the heat development photosensitive elements and various layers, in addition to photosensitive layers, such as a protective layer, an interlayer, an antistatic layer, and antihalation layer, a peel layer which facilitates separation from a dye fixing element, and a matting layer. Examples of said various additives include plasticizers, matting agents, dyes for improving sharpness, antihalation dyes, surfactants, fluorescent whitening agents, anti-slip agents, antioxidants, fading preventives, diffusible dye-trapping agents, as described in *Research Disclosure* (June, 1978, pp.9–15), JP-A-61-88256, etc.

Organic or inorganic matting agents may be usually added to the protective layer to prevent blocking. Further, mordants and ultraviolet absorbing agents may be incorporated into the protective layers. The protective layer and the interlayer may be constituted of two or more layers, respectively.

To prevent fading and color amalgamation, reducing agents, ultraviolet absorbing agents, or white pigments such as titanium dioxide may be added to the interlayer. The white pigments may be added not only to the interlayer but also to the emulsion layer to improve sensitivity.

For the dye fixing element, auxiliary layers such as a protective layer, a peel layer, or an anticurl layer can be provided, as needed. Particularly, it is useful to provide the protective layer. One or more layers of these layers may contain hydrophilic heat solvents, plasticizers, fading preservatives, ultraviolet absorbing agents, anti-slip agents, matting agents, antioxidants, dispersed vinyl compounds to improve dimensional stability, surfactants, fluorescent whitening agents, and the like. In a system in which heat development and dye diffusion transfer are simultaneously carried out in the presence of a small amount of water, bases or base precursors described below are preferably incorporated into the dye fixing element to increase storability of the dye fixing element. Examples of these additives are described in JP-A-61-88256, pp.101–120.

In the present invention, image formation accelerators can be used for the photosensitive element and/or the color fixing element. The image formation accelerators have some functions such as promotion of the redox reaction between silver salt oxidizing agents and reducing agents; promotion of reactions such as formation of dyes, cleavage of dyes, or releasing of diffusible dyes from the dye image formation compounds containing color developing agents and couplers of the present invention; and promotion of dye transfer from constituent layers of the photosensitive elements to the dye fixing layer. From the physicochemical functions, the image formation accelerators are classified into compounds having interactions with bases or base precursors, compounds having interaction with nucleophilic compounds, compounds having interaction with high boiling organic solvents (oils), compounds having interaction with heat solvents, compounds having interaction with surfactants, and compounds having interaction with silver or silver ion, with the proviso that these image formation accelerators each generally have complex functions, that is, simultaneously have some of these functions in usual. These interactions are described in detail in JP-A-61-93451, pp.67–71.

There are various procedures for generating bases, and all compounds used in these procedures are useful as base precursors. For example, there are a procedure of generating a base by mixing an insoluble metallic compound with a compound which can form a complex with the metallic ion, a constituent of the insoluble metallic compound, (The compound is called a "complex formation compound") as described in European Pat. No. 0210660A2 and a procedure of generating a base by electrolysis as described in JP-A-61-232451.

The former procedure is particularly effective. The insoluble metallic salts include carbonates, hydroxides, and oxides of zinc, aluminum, calcium, and barium. On the other hand, the complex formation compounds are described in detail, for example, in A. E. Martell and R. M. Smith, *Critical Stability Constants*, Vols. 4 and 5, Plenum Press. Examples thereof include alkali metal salts, guanidine salts, amidine salts, and quaternary ammonium salts of aminocarboxylic acids, iminodiacetic acids, pyridinecarboxylic acids, aminophosphoric acids, carboxylic acids (mono-, di-, tri-, and tetracarboxylic acids, and further, these compounds containing a substituent group such as phosphono, hydroxy, oxo, ester, amido, alkoxy, mercapto, alkylthio, or phosphino), hydroxamic acids, polyacrylates, polyphosphoric acids. It is advantageous that the insoluble metallic compounds and the complex formation compounds are separately added to the photosensitive element and the dye fixing element.

In the present invention, development inhibitors can be used for the photosensitive element and/of the dye fixing element to constantly obtain images stable to variations in processing temperatures and processing time.

The development inhibitors herein mean compounds which swiftly neutralize bases or lower base concentration in membrane by reacting with the bases immediately after completing proper development to stop development, or compounds which have interactions with silver or silver salts to inhibit development. Examples of the development inhibitors include acid precursors from which acids are released by heating, electrophilic compounds which are subjected to displacement reactions with bases coexisting with the compounds by heating, nitrogen-containing heterocyclic compounds, and mercapto compounds and their precursors (for example, compounds described in JP-A-60-108837, JP-A-60-192939, JP-A-60-230133, and JP-A-60-230134). Further, compounds from which mercapto compounds are released by heating also are useful, and these compounds are described, for example, in JP-A-61-67851, JP-A-61-147244, JP-A-61-124941, JP-A-61-185743, JP-A-61-182039, JP-A-61-185744, JP-A-61-184539, JP-A-61-188540, and JP-A-61-53632.

In the present invention, hydrophilic binders can be used for the photosensitive element and the dye fixing element. The hydrophilic binders are typically transparent or translucent, and include natural substances such as proteins (for example, gelatin or gelatin derivatives) and polysaccharides (for example, cellulose derivatives, starch, or gum arabic); and synthetic polymeric substances such as water-soluble polyvinyl compounds (for example, polyvinyl pyrrolidone or polyacrylamide). Dispersed vinyl compounds in a latex state can also be used for improving dimensional stability of the photographic materials. These binders can be used, singly or in combination.

In the present invention, the coating amounts of the binders are 20 g/m$^2$ or less, preferably 10 g/m$^2$, and particularly preferably 7 g/m$^2$.

The high boiling organic solvents which are dispersed into the binders with hydrophobic compounds such as the color developing agents and couplers of the present invention are used in amounts of 1 cc or less, preferably 0.5 cc or less, and more preferably 0.3 cc or less per g of the binders.

Inorganic or organic hardening agents may added to the constituent layers (photographic emulsion layer, dye fixing layer, etc.) of the photosensitive element and/or the dye fixing element of the present invention. Examples of the hardening agents include those which are described in JP-A-61-147244 (pages 94 and 95) and JP-A-59-157636 (page 38). These hardening agents can be used, singly or in combination.

To promote dye transfer, hydrophilic heat solvents which are solid at ordinary temperature and are melt at high temperatures may be incorporated into the photosensitive element or the dye fixing agent. The hydrophilic heat solvents may be incorporated either into the photosensitive element or into the dye fixing element, or they may be incorporated into both the elements. Although layers into which the hydrophilic heat solvents are incorporated may be any of the emulsion layer, the interlayer, the protective layer, and the dye fixing layer preferred layers are the dye fixing layer and/or a layer adjacent to the dye fixing layer. Examples of the hydrophilic heat solvents include ureas, pyridines, amides, sulfonamides, imides, alcohols, oximes, and other heterocycles. To promote the dye transfer, the high boiling organic solvents may be contained in the photosensitive element and/or the dye fixing element.

In the present invention, supports used for the photosensitive element and/or the dye fixing element are those which can resist processing temperatures. The supports used generally are glass, paper, polymer film, and metal and the like, and in addition, those described in JP-A-61-147244, pages 95 and 96.

The photosensitive element and/or the dye fixing element may be of a form having a conductive, heat-generating layer as a means of heating for the heat development or the dye transfer. In this case, a transparent or opaque heat-generating element can be made by using a known technique for a resistance heating element. For preparation of the resistance heating element, there are a method of utilizing the thin membrane of a semiconductive inorganic material and a method of utilizing an organic thin membrane in which conductive fine particles are dispersed into a binder. Materials usable in these methods are described in JP-A-61-29835, etc.

In the present invention, a method of coating described in U.S. Pat. No. 4,500,626 (columns 55 and 56) can be applied to formation of a heat development photosensitive layer, a protective layer, an interlayer, an undercoat layer, a backing layer, a dye fixing layer, and other layers.

Radiations including visible light can be used as light sources of image exposure to record images in the photosensitive element. In general, light sources for usual color prints can be used, which include a tungsten lamp, a mercury vapor lamp, a halogen lamp such as a quartz-iodine lamp, a xenon lamp, a laser beam, a CRT light source, a light emission diode (LED), and light sources described in JP-A-61-147244 (page 100) and U.S. Pat. No. 4,500,626 (column 56).

In a process for the image formation involving a heating step which is applied to the present invention, the heat development and the dye transfer may be carried out, either independently or simultaneously, or further, may be successively carried out in one step, in which the dye transfer follows the heat development. For example, there are process (1) of superposing the dye fixing element on the photosensitive element which has undergone image exposure and has been heated, and then transferring mobile dyes to the dye fixing element by heating as needed, and process (2) of superposing the fixing element on the photosensitive element which has undergone image exposure, and then heating. These processes (1) and (2) can be performed either in the substantial absence of water or in the presence of a small amount of water.

The heat development is performed at temperatures of from about 50 to about 250° C., more preferably from 70 to 180° C., and particularly preferably from 75 to 150° C. When heat is applied in the presence of a small amount of water, the heating temperatures is not higher than the boiling point. When the dye transfer is performed after the heat development, the dye transfer can be performed at heating temperatures ranging from the temperatures of the heat development to room temperature, and more preferably from 50° to temperatures about 10° C. lower than that of the heat development.

A preferred process for forming images in the present invention is that heat is applied in the presence of a small amount of water and a base and/or a base precursor at the same time that the image exposure is performed, and the diffusible dyes formed in portions corresponding to or reversely corresponding to silver images are transferred to the dye fixing layer at the same time that the development is performed. By this process, the formation or release reaction of the diffusible dyes proceeds very rapidly, and the transfer of the diffusible dyes to the dye fixing layer also proceeds rapidly to obtain high densities of color images in a short period of time.

The quantity of water used in this embodiment may be as small as from at least 0.1 times the weight of all membranes constituting the photosensitive element and the dye fixing layer to the weight of solvent corresponding to the maximum swelling volume of all constituent membranes (particularly, not greater than the quantity after subtracting the weight of all the constituent membranes from the weight of solvent corresponding to the maximum swelling volume of all the constituent membranes).

The state of membranes are unstable on swelling, and blur might be locally generated in some conditions. To avoid this, it is preferred that the quantity of water is not greater than the quantity corresponding to the maximum swelling volume of all the membranes constituting the photosensitive element and the dye fixing element. Specifically, the quantity of water preferably ranges from 1 to 50 g, more preferably from 2 to 35 g, and most preferably from 3 to 25 g per $m^2$ of the total areas of the photosensitive element and the dye fixing element.

The bases and/or base precursors used in this embodiment can be incorporated into either the photosensitive element or the dye fixing element. Or the bases dissolved in water can also be supplied.

In the embodiment, it is preferred that both water-insoluble (slightly water-soluble) basic metallic compounds and compounds which can undergo complex formation reactions with the constituent metallic ions of the water-insoluble metallic compounds in aqueous media are contained as base precursors in the image formation reaction system, and the pH of the system is raised by the reaction between both the compounds on heating. The image formation reaction system herein means the areas in which the image formation reaction takes place. Specifically, the areas include the layers belonging to both the photosensitive element and the dye fixing element, and when two or more layers are present, the areas may be either of these layers.

To prevent the water-insoluble metallic compounds and the complex formation compounds from reacting with each other before processing, it is necessary to separately add both the compounds to different layers. For example, in a so-called monosheet material in which the photosensitive element and the dye fixing element are provided on a single support, both the compounds are separately added to different layers, and one or more other layers are preferably provided between these layers. A more preferred form is what the insoluble metallic compounds and the complex formation compounds are separately added to layers provided on different supports. For example, it is preferred that the insoluble metallic compounds are incorporated into the photosensitive element, whereas the complex formation compounds are incorporated into the dye fixing element provided on a support different from the support on which the photosensitive element is provided. The complex formation compounds dissolved in water which is allowed to coexist may be supplied. The insoluble metallic compounds are preferably added as fine particle dispersions which are prepared by a process described in JP-A-56-17480, JP-A-53-102733, etc., and the average particle sizes are preferably 50 μm or less, and particularly preferably 5 μm or less. The insoluble metallic compounds may be added to any layer of the photosensitive element, such as the photosensitive layer, the interlayer, and the protective layer, or may be dividedly added to the two or more layers.

The quantities of the insoluble metallic compounds and the complex formation compounds added to the layers on a support depend upon the kinds of the compounds, the particle sizes of the insoluble metallic compounds, the rates of the complex formation reaction, and the like. However, in general, the quantities are suitably 50% by weight or less, more preferably from 0.01 to 40% by weight, based on the weight of the layers to which these compounds are added. When the complex formation compounds dissolved in water are supplied, the concentrations thereof are preferably from 0.005 to 5 mole/liter, and particularly preferably from 0.05 to 2 mole/liter. Further, in the present invention, the quantities of the complex formation compounds in the reaction system are preferably from 1/100 to 100 times, and particularly preferably from 1/10 to 20 times those of the insoluble metallic compounds in molar ratio.

The method of feeding water to the photosensitive layer or the dye fixing layer is described in JP-A-61-147244 (page 101, line 9 to page 102, line 4).

Heating in the development and/or transfer steps is performed by use of heat plates, flatirons, heat rollers, or the like as described in JP-A-61-147244 (page 102, line 14 to page 103, line 11). It also is possible to perform direct heating by superposing a conductive layer composed of an electrically conductive material such as graphite, carbon black or metals on the photosensitive element and/or the dye fixing element and electrifying the conductive layer.

The conditions of pressing the photosensitive element superposed on the dye fixing element to come into close contact with each other and methods for pressing, which can be applied to the present invention, are described in JP-A-61-147244 (pages 103 and 104).

Any of various heat development devices can be used for the processing of the photographic element of the present invention. For example, the devices described in JP-A-59-75247, JP-A-59-177547, JP-A-59-181353, JP-A-60-18951, JP-A-U-62-25944 (The term "JP-A-U" as used herein means an "unexamined published Japanese utility model application"), etc. can be preferably used.

The effect of the present invention is illustrated by means of the following examples in detail.

EXAMPLE 1

Preparation of Photosensitive Silver Halide Emulsions

Photosensitive Silver Halide Emulsion (1) [For Red Sensitive Emulsion Layer]

To a well-stirred aqueous solution of gelatin (prepared by adding 16 g of gelatin, 0.24 g of potassium bromide, 1.6 g of sodium chloride, and 24 mg of compound (a) to 540 ml of water, and warmed to 55° C.), liquid (1) and liquid (2) shown in Table 1 were simultaneously added at the same flow rate over a 19-minute period. After 5 minutes, liquid (3) and liquid (4) shown in Table 1 were simultaneously added to the resulting mixture at the same flow rate over a 24-minute period. After the reaction mixture was washed with water and was subjected to salt removal in the usual way, 17.6 g of lime-treated ossein gelatin and 56 mg of compound (b) were then added thereto to be adjusted to pH 6.2 and pAg 7.7. Subsequently, 0.41 g of a decomposition product of ribonucleic acid and 1.02 mg of trimethylthiourea were added to the resulting emulsion which appropriately underwent chemical sensitization at 60° C. Thereafter, 0.18 g of 4-hydroxy-6-methyl-1,3,3a, 7-tetrazaindene, 64 mg of sensitizing dye (c), 0.41 g of potassium bromide were successively added to the emulsion, and then cooled. Thus, 590 g of a monodispersed cubic silver chlorobromide emulsion having an average grain size of 0.30 μm was obtained.

TABLE 1

| | Liquid (1) | Liquid (2) | Liquid (3) | Liquid (4) |
|---|---|---|---|---|
| $AgNO_3$ | 24.0 g | — | 56.0 g | — |
| $NH_4NO_3$ | 50.0 mg | — | 50.0 mg | — |
| KBr | — | 10.9 g | — | 35.5 g |
| NaCl | — | 2.88 g | — | 1.92 g |
| $K_2IrCl_6$ | — | 0.07 mg | — | — |
| Final Volume | to 130 ml with water | to 200 ml with water | to 130 ml with water | to 200 ml with water |

Compound (a)

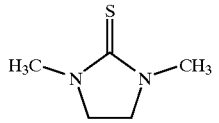

Compound (b)

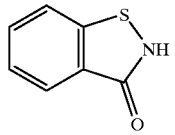

Sensitizing Dye (c)

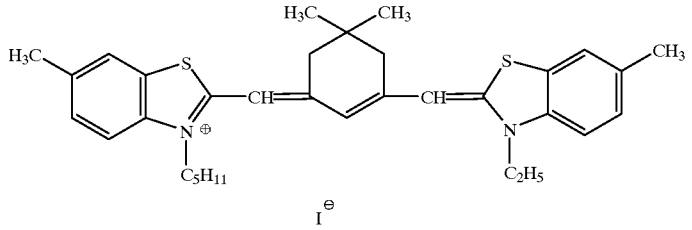

Photosensitive Silver Halide Emulsion (2) [For Green Sensitive Emulsion Layer]

To a well-stirred aqueous solution of gelatin (prepared by adding 20 g of gelatin, 0.30 g of potassium bromide, 2.0 g of sodium chloride and 30 mg of compound (a) to 600 ml of water, and warmed to 46° C.), liquid (1) and liquid (2) shown in Table 2 were simultaneously added at the same flow rate over a 10-minute period. After 5 minutes, liquid (3) and liquid (4) shown in Table 2 were simultaneously added at the same flow rate over a 30-minute period. After 1 minute after completing the addition of liquid (3) and liquid (4), 60 ml of a methanol solution of sensitizing dyes (containing 360 mg of sensitizing dye ($d_1$) and 73.4 mg of sensitizing dye ($d_2$)) was added at one time. After the reaction mixture was washed with water and was subjected to salt removal (conducted at pH 4.0 by use of precipitant (e)) in the usual way, 22 g of lime-treated ossein gelatin was added thereto to be adjusted to pH 6.0 and pAg 7.6. Subsequently, 1.8 mg of sodium thiosulfate and 180 mg of 4-hydroxy-6-methyl-1,3,3a,7-tetrazaindene were added to the resulting emulsion which appropriately underwent chemical sensitization at 60° C. Thereafter, 90 mg of antifoggant (f), 70 mg of compound (b) and 3 ml of compound (g) as preservatives were added, and then cooled. Thus, 635 g of a monodispersed cubic silver chlorobromide emulsion having an average grain size of 0.30 μm was obtained.

TABLE 2

| | Liquid (1) | Liquid (2) | Liquid (3) | Liquid (4) |
|---|---|---|---|---|
| $AgNO_3$ | 10.0 g | — | 90.0 g | — |
| $NH_4NO_3$ | 60.0 mg | — | 380 mg | — |
| KBr | — | 3.50 g | — | 57.1 g |
| NaCl | — | 1.72 g | — | 3.13 g |

TABLE 2-continued

| | Liquid (1) | Liquid (2) | Liquid (3) | Liquid (4) |
|---|---|---|---|---|
| $K_2IrCl_6$ | — | — | — | 0.03 mg |
| Final Volume | to 126 ml with water | to 131 ml with water | to 280 ml with water | to 289 ml with water |

Sensitizing Dye ($d_1$)

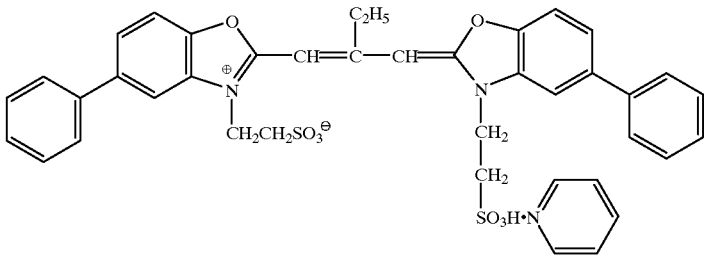

Sensitizing Dye ($d_2$)

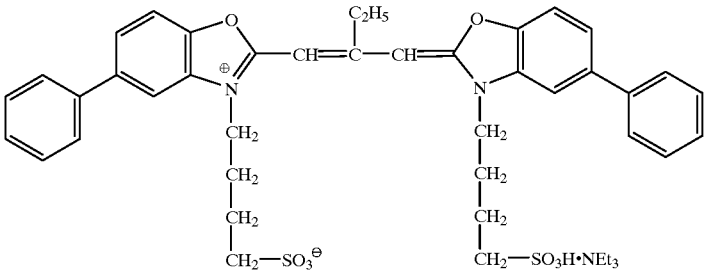

Precipitant (e) supplied as a mixture (n = 6–10)

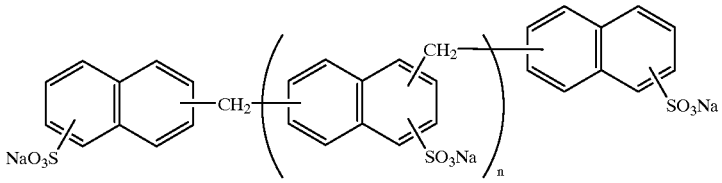

Antifoggant (f)

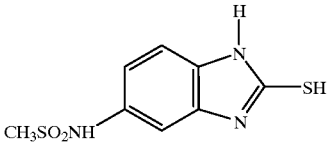

Compound (g)

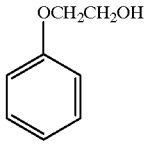

Photosensitive Silver Halide Emulsion (3) [For Blue Sensitive Emulsion Layer]

To a well-stirred aqueous solution of gelatin (prepared by adding 31.6 g of gelatin, 2.5 g of potassium bromide and 13 mg of compound (a) to 584 ml of water, and warmed to 70° C.), addition of liquid (2) shown in Table 3 was first initiated, and after 10 seconds, addition of liquid (1) was initiated. Both the liquids are then added over a 30-minute period, respectively. After 5 minutes after completing the addition of liquid (2), addition of liquid (4) shown in Table 3 was initiated, and after 10 seconds thereafter, addition of liquid (3) was initiated. Liquid (3) was added over a period of 27 minutes and 50 seconds, and liquid (4) over a period of 28 minutes. After the reaction mixture was washed with water and was subjected to salt removal (conducted at pH 3.9 by use of precipitant (e)) in the usual way, 24.6 g of lime-treated ossein gelatin and 56 mg of compound (b) were added thereto to be adjusted to pH 6.1 and pAg 8.5. Subsequently, 0.55 mg of sodium thiosulfate was added to the resulting emulsion which appropriately underwent chemical sensitization at 65° C. Subsequently, 0.35 g of sensitizing dye (h), 56 mg of antifoggant (i) and 2.3 ml of compound (g) as a preservative were added thereto, and then cooled. Thus, 582 g of a monodispersed octahedral silver bromide emulsion having an average grain size of 0.55 μm was obtained.

TABLE 3

| | Liquid (1) | Liquid (2) | Liquid (3) | Liquid (4) |
|---|---|---|---|---|
| $AgNO_3$ | 15.8 g | — | 72.2 g | — |
| $NH_4NO_3$ | 68.0 mg | — | 308 mg | — |
| KBr | — | 11.4 g | — | 52.2 g |
| Final Volume | to 134 ml with water | to 134 ml with water | to 194 ml with water | to 195 ml with water |

Sensitizing Dye (h)

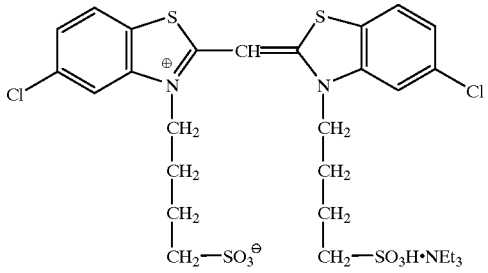

Antifoggant (i)

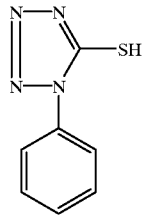

Preparation of Zinc Hydroxide Dispersion

A mixture of 31 g of powdered zinc hydroxide having a primary particle size of 0.2 μm, 1.6 g of carboxymethyl cellulose as a dispersing agent, 0.4 g of sodium polyacrylate, and 8.5 g of lime-treated ossein gelatin was dispersed into 158.5 ml of water in a mill using glass beads for 1 hour. The resulting dispersion was then separated from glass beads by filtration to obtain 188 g of a zinc hydroxide dispersion.

Preparation of Emulsified Dispersion of Couplers

Oil phase components and aqueous phase components having compositions shown in Table 4 were uniformly dissolved, respectively, and the solutions obtained were maintained at 60° C. Both the solution were combined and dispersed in an 1-liter stainless vessel by use of a dissolver equipped with a disperser having a diameter of 5 cm at 10,000 rpm for 20 minutes. Warm water in amounts shown in Table 4 was added thereto as after-addition water, and mixed at 2000 rpm for 10 minutes. Thus, emulsified dispersions containing couplers for cyan, magenta and yellow colors were prepared, respectively.

TABLE 4

| | Cyan | Magenta | Yellow |
|---|---|---|---|
| Cyan Coupler (C-31) | 4.57 g | — | — |
| Magenta Coupler (C-33) | — | 4.43 g | — |
| Yellow Coupler (C-6) | — | — | 4.54 g |
| Color Developing Agent (Ex-1) | 2.40 g | 2.40 g | 2.40 g |

TABLE 4-continued

| | Cyan | Magenta | Yellow |
|---|---|---|---|
| Antifoggant (5) | 30 mg | 100 mg | 300 mg |
| High Boiling Solvent (6) | 3.50 g | 3.42 g | 3.47 g |
| Ethyl Acetate | 24 ml | 24 ml | 24 ml |
| Lime-Treated Gelatin | 10.0 g | 10.0 g | 10.0 g |
| Surfactant (7) | 0.50 g | 0.50 g | 0.50 g |
| Water | 75.0 ml | 75.0 ml | 75.0 ml |
| After-addition Water | 80.0 ml | 80.0 ml | 80.0 ml |

Color Developing Agent (Ex-1)

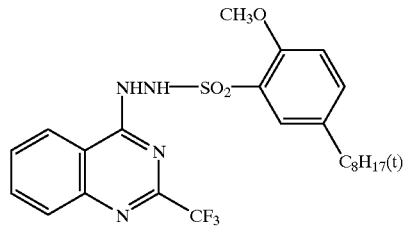

TABLE 4-continued

| | Cyan | Magenta | Yellow |
|---|---|---|---|

Antifoggant (5)

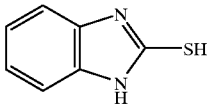

High Boiling Solvent (6)

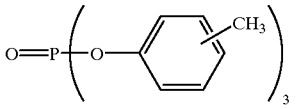

Surfactant (7)

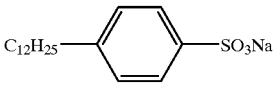

Heat development dry color photosensitive material 101 having a multilayer structure shown in Table 5 was prepared by use of the materials thus obtained.

TABLE 5

Constitution of Photosensitive Material 101

| Constituent Layers | Material Added | Content ($mg/m^2$) |
|---|---|---|
| 6th Layer Protective Layer | Lime-Treated Gelatin | 1940 |
| | Matting Agent (Silica) | 200 |
| | Surfactant (8) | 50 |
| | Surfactant (9) | 300 |
| | Zinc Hydroxide | 600 |
| | Water-Soluble Polymer (10) | 120 |
| 5th Layer Yellow Color Layer | Lime-Treated Gelatin | 1500 |
| | Blue Sensitive Silver Halide Emulsion | 864 (in terms of Silver) |
| | Yellow Coupler (C-6) | 965 |
| | Color Developing Agent (Ex-1) | 510 |
| | High Boiling Solvent (6) | 737 |
| | Surfactant (7) | 70 |
| | Water-Soluble Polymer (10) | 40 |
| 4th Layer Interlayer | Lime-Treated Gelatin | 970 |
| | Surfactant (8) | 50 |
| | Surfactant (9) | 300 |
| | Zinc Hydroxide | 400 |
| | Water-Soluble Polymer (10) | 60 |
| 3rd Layer Magenta Color Layer | Lime-Treated Gelatin | 1500 |
| | Green Sensitive Silver Halide Emulsion | 864 (in terms of Silver) |
| | Magenta Coupler (C-33) | 660 |
| | Color Developing Agent (Ex-1) | 357 |
| | High Boiling Solvent (6) | 509 |
| | Surfactant (7) | 50 |
| | Water-Soluble Polymer (10) | 20 |
| 2nd Layer Interlayer | Lime-Treated Gelatin | 970 |
| | Surfactant (8) | 50 |
| | Surfactant (9) | 300 |
| | Zinc Hydroxide | 400 |
| | Water-Soluble Polymer (10) | 60 |
| 1st Layer Cyan Color Layer | Lime-Treated Gelatin | 1500 |
| | Red Sensitive Silver Halide Emulsion | 864 (in terms of Silver) |

TABLE 5-continued

Constitution of Photosensitive Material 101

| Constituent Layers | Material Added | Content ($mg/m^2$) |
|---|---|---|
| | Cyan Coupler (C-31) | 486 |
| | Color Developing Agent (Ex-1) | 281 |
| | High Boiling Solvent (6) | 384 |
| | Surfactant (7) | 40 |
| | Water-Soluble Polymer (10) | 20 |
| | Transparent PET Base (102 $\mu$m) | |

Surfactant (8)

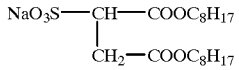

Surfactant (9)

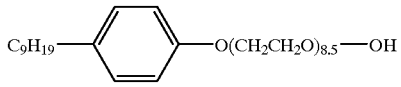

Water-Soluble Polymer (10)

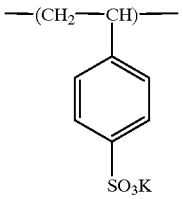

Subsequently, photosensitive materials 102 to 107 having the same composition as that of photosensitive material 101 except that developing agents were replaced as shown in Table 6 were prepared, respectively. These samples were exposed to light under 2500 lux for 0.1 second through a blub filter, a green filter or a red filter having densities which continuously change. These exposed samples were dipped into warm water of 40° C., and then excess water was squeezed from the samples by use of rubber rollers to leave 15 $ml/m^2$ of water to the surfaces of the photosensitive materials. The surfaces of the photosensitive materials were brought into contact with the surfaces of image receiving materials R-1 which contain a base generator described in an example of JP-A-5-188554, and heat development was performed at 83° C. for 30 seconds. Thereafter, the image receiving materials were separated from the photosensitive materials to obtain on the image receiving materials sharp images of cyan, magenta and yellow colors corresponding to a blue filter, a green filter and a red filter through which the photosensitive materials were exposed to light. The maximum densities ($D_{max}$) and the minimum densities ($D_{min}$) of these samples were measured with a densitometer X-rite. Results are shown in Table 6.

TABLE 6

| Photo-sensitive Material No. | Color Forming Layer | Color Developing Agent No. | Coupler No. | Yellow ($D_{max}/D_{min}$) | Magenta ($D_{max}/D_{min}$) | Cyan ($D_{max}/D_{min}$) | Notes |
|---|---|---|---|---|---|---|---|
| 101 | Yellow | (Ex-1) | (C-6) | 0.18/0.16 | — | — | Comparative |
| | Magenta | (Ex-1) | (C-33) | — | 0.15/0.12 | — | Example |
| | Cyan | (Ex-1) | (C-31) | — | — | 0.17/0.15 | |
| 102 | Yellow | (13) | (C-6) | 1.30/0.28 | — | — | Present |
| | Magenta | (13) | (C-33) | — | 1.80/0.25 | — | Invention |
| | Cyan | (13) | (C-31) | — | — | 1.70/0.30 | |
| 103 | Yellow | (21) | (C-6) | 0.95/0.25 | — | — | Present |
| | Magenta | (21) | (C-33) | — | 1.53/0.21 | — | Invention |
| | Cyan | (21) | (C-31) | — | — | 1.25/0.23 | |
| 104 | Yellow | (60) | (C-6) | 1.11/0.30 | — | — | Present |
| | Magenta | (60) | (C-33) | — | 1.59/0.12 | — | Invention |
| | Cyan | (60) | (C-31) | — | — | 1.32/0.32 | |
| 105 | Yellow | (17) | (C-3) | 1.87/0.35 | — | — | Present |
| | Magenta | (17) | (C-26) | — | 1.61/0.25 | — | Invention |
| | Cyan | (17) | (C-28) | — | — | 1.66/0.15 | |
| 106 | Yellow | (56) | (C-14) | 1.23/0.16 | — | — | Present |
| | Magenta | (56) | (C-38) | — | 1.35/0.15 | — | Invention |
| | Cyan | (56) | (C-45) | — | — | 1.49/0.16 | |
| 107 | Yellow | (64) | (C-17) | 1.28/0.20 | — | — | Present |
| | Magenta | (36) | (C-43) | — | 1.64/0.14 | — | Invention |
| | Cyan | (49) | (C-37) | — | — | 1.57/0.17 | |

Table 6 reveals that use of the developing agents of the present invention makes it possible to form diffusible dyes by a coupling reaction and that the photosensitive material system like the example of the present invention can afford sharp color images.

EXAMPLE 2

Photosensitive material 201 was prepared by providing constituent layers as shown in Tables 7 to 9 on a support composed of a transparent polyethylene terephthalate film having a thickness of 150 $\mu$m.

TABLE 7

Constitution of Photosensitive Element 201

| Layer No. | Name of Layer | Additives | Coating Amounts ($g/m^2$) |
|---|---|---|---|
| 21th Layer | Protective Layer | Gelatin | 1.00 |
| | | Matting Agent (1) | 0.25 |
| 20th Layer | UV Absorb-ing Layer | Gelatin | 0.50 |
| | | UV Absorbing Agent (1) | 0.09 |
| | | UV Absorbing Agent (2) | 0.08 |
| 19th Layer | Blue Sensi-tive Layer (High Sensitivity) | Internal Latent Image Type Direct Positive Emulsion (Grain Size: 1.7 $\mu$m, Octahedron) | 0.50 in terms of silver |
| | | Sensitizing Dye (3) | $1.4 \times 10^{-3}$ |
| | | Nucleating Agent (1) | $8.0 \times 10^{-6}$ |
| | | Additive (2) | 0.03 |
| | | Gelatin | 0.70 |
| 18th Layer | Blue Sensi-tive Layer (Low Sensitivity) | Internal Latent Image Type Direct Positive Emulsion (Grain Size: 1.1 $\mu$m, Octahedron) | 0.20 in terms of silver |
| | | Sensitizing Dye (3) | $9.0 \times 10^{-4}$ |
| | | Nucleating Agent (1) | $3.0 \times 10^{-6}$ |
| | | Additive (2) | $4.5 \times 10^{-2}$ |
| | | Gelatin | 0.40 |
| 17th Layer | White Reflec-tion Layer | Titanium Dioxide | 0.70 |
| | | Gelatin | 0.18 |
| 16th Layer | Yellow Dye Donative Layer | Yellow Dye Donative Compound (1) | 0.53 |
| | | High Boiling Organic Solvent (1) | 0.26 |

TABLE 7-continued

Constitution of Photosensitive Element 201

| Layer No. | Name of Layer | Additives | Coating Amounts ($g/m^2$) |
|---|---|---|---|
| | | Additive (1) | $1.4 \times 10^{-2}$ |
| | | Gelatin | 0.70 |
| 15th Layer | Interlayer | Gelatin | 0.30 |
| 14th Layer | Color Amal-gamation Preventive Layer | Additive (1) | 0.80 |
| | | Polymethyl Methacrylate | 0.80 |
| | | Gelatin | 0.45 |

TABLE 8

Constitution of Photosensitive Element 201

| Layer No. | Name of Layer | Additives | Coating Amounts ($g/m^2$) |
|---|---|---|---|
| 13th Layer | Green Sensi-tive Layer (High Sensitivity) | Internal Latent Image Type Direct Positive Emulsion (Grain Size: 1.6 $\mu$m, Octahedron) | 0.64 in terms of silver |
| | | Sensitizing Dye (2) | $2.1 \times 10^{-3}$ |
| | | Nucleating Agent (1) | $4.0 \times 10^{-6}$ |
| | | Additive (2) | 0.08 |
| | | Gelatin | 1.00 |
| 12th Layer | Green Sensi-tive Layer (Low Sensitivity) | Internal Latent Image Type Direct Positive Emulsion (Grain Size: 1.0 $\mu$m, Octahedron) | 0.20 in terms of silver |
| | | Sensitizing Dye (2) | $1.1 \times 10^{-3}$ |
| | | Nucleating Agent (1) | $3.0 \times 10^{-6}$ |
| | | Additive (2) | 0.03 |
| | | Gelatin | 0.50 |
| 11th Layer | White Reflec-tion Layer | Titanium Dioxide | 1.00 |
| | | Gelatin | 0.25 |
| 10th Layer | Magenta Dye Donative Layer | Magenta Dye Donative Compound (1) | 0.50 |
| | | High Boiling Organic Solvent (1) | 0.20 |

TABLE 8-continued

Constitution of Photosensitive Element 201

| Layer No. | Name of Layer | Additives | Coating Amounts ($g/m^2$) |
|---|---|---|---|
| | | Additive (1) | $9.0 \times 10^{-3}$ |
| | | Gelatin | 0.70 |
| 9th Layer | Interlayer | Gelatin | 0.30 |
| 8th Layer | Color Amalgamation Preventive Layer | Additive (1) | 1.20 |
| | | Polymethyl Methacrylate | 1.20 |
| | | Gelatin | 0.70 |
| 7th Layer | Red Sensitive Layer (High Sensitivity) | Internal Latent Image Type Direct Positive Emulsion (Grain Size: 1.6 μm, Octahedron) | 0.40 in terms of silver |
| | | Sensitizing Dye (1) | $6.2 \times 10^{-4}$ |
| | | Nucleating Agent (1) | $8.5 \times 10^{-6}$ |
| | | Additive (2) | 0.04 |
| | | Gelatin | 1.80 |

TABLE 9

Constitution of Photosensitive Element 201

| Layer No. | Name of Layer | Additive s | Coating Amounts ($g/m^2$) |
|---|---|---|---|
| 6th Layer | Red Sensitive Layer (Low Sensitivity) | Internal Latent Image Type Direct Positive Emulsion (Grain Size: 1.0 μm, Octahedron) | 0.12 in terms of silver |
| | | Sensitizing Dye (1) | $3.0 \times 10^{-4}$ |
| | | Nucleating Agent (1) | $1.0 \times 10^{-5}$ |
| | | Additive (2) | 0.02 |
| | | Gelatin | 0.40 |
| 5th Layer | White Reflection Layer | Titanium Dioxide | 3.00 |
| | | Gelatin | 0.80 |
| 4th Layer | Cyan Dye Donative Layer | Cyan Dye Donative Compound (1) | 0.50 |
| | | High Boiling Organic Solvent (1) | 0.20 |
| | | Additive (1) | 0.10 |
| | | Gelatin | 1.0 |
| 3rd Layer | Opaque Layer | Carbon Black | 1.70 |
| | | Gelatin | 1.70 |
| 2nd Layer | White Reflection Layer | Titanium Dioxide | 22.0 |
| | | Gelatin | 2.75 |
| 1st Layer | Image Receiving Layer | Polymer Mordant | 3.00 |
| | | Gelatin | 3.00 |
| Support (Polyethylene Terephthalate, 150 μm) | | | |

Polymer Mordant (1)

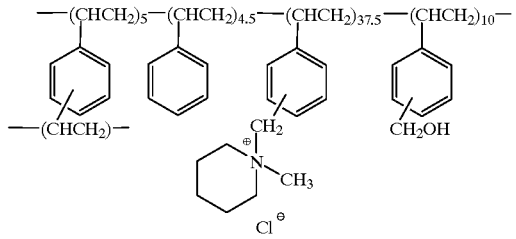

TABLE 9-continued
| Constitution of Photosensitive Element 201 | | | |
|---|---|---|---|
| Layer No. | Name of Layer | Additive s | Coating Amounts ($g/m^2$) |
UV Absorbing Agent (1)
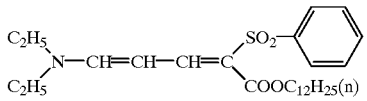
UV Absorbing Agent (2)
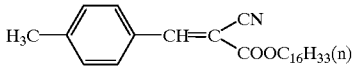
Matting Agent (1)
Polymethyl Methacrylate Sphere Latex (Average Particle Size: 4 $\mu$m)
Cyan Dye Donative Compound (1)
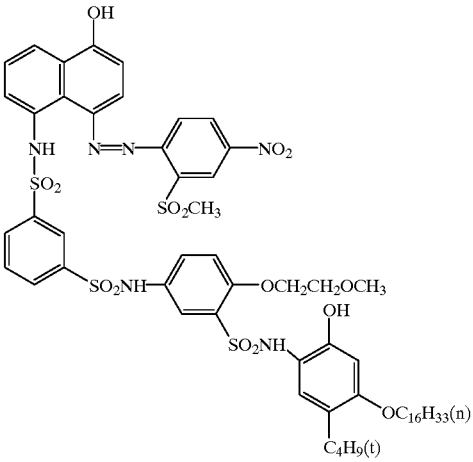
Magenta Dye Donative Compound (1)
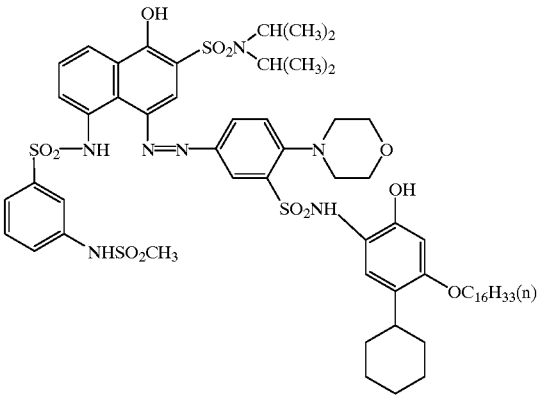

TABLE 9-continued
Constitution of Photosensitive Element 201
| Layer No. | Name of Layer | Additive s | Coating Amounts ($g/m^2$) |
|---|---|---|---|
Yellow Dye Donative Compound (1)
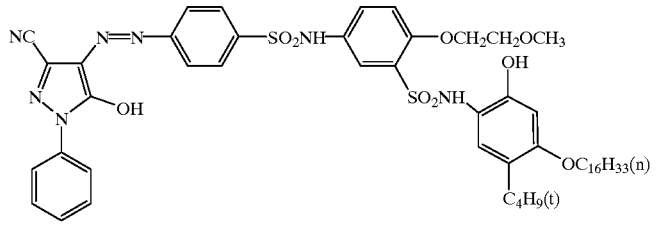
Additive (1)
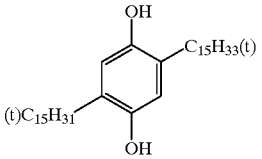
Additive (2)
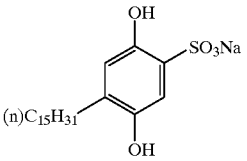
High Boiling Organic Solvent (1) Tricyclohexyl Phosphate
Nucleating Agent (1)
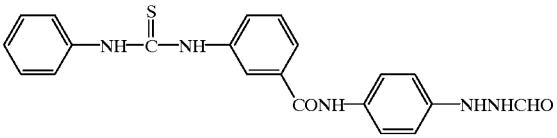
Sensitizing Dye (1)
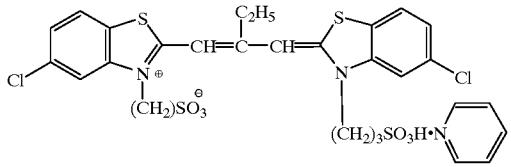
Sensitizing Dye (2)
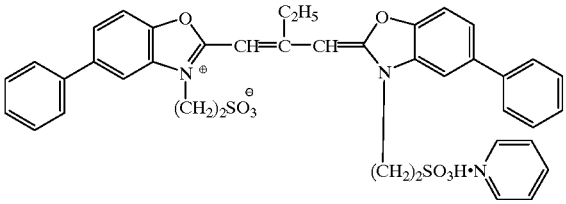

TABLE 9-continued

| Constitution of Photosensitive Element 201 | | | |
|---|---|---|---|
| Layer No. | Name of Layer | Additive s | Coating Amounts ($g/m^2$) |

Sensitizing Dye (3)

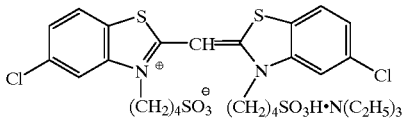

Subsequently, photosensitive materials 202 to 205 were prepared in the same manner as above except that dye donative substances in the 16th, 10th and 4th layers were replaced as shown in Table 10.

TABLE 10

| Photo-sensitive Material No. | Color forming Layer | Color Develop-ing Agent No. | Coupler No. | Yellow ($D_{max}/D_{min}$) | Magenta ($D_{max}/D_{min}$) | Cyan ($D_{max}/D_{min}$) | Notes |
|---|---|---|---|---|---|---|---|
| 201 | Yellow | (Yellow Dye Donative Compound 1) | | 1.78/0.21 | — | — | Comparative |
| | Magenta | (Magenta Dye Donative Compound 1) | | — | 2.05/0.22 | — | |
| | Cyan | (Cyan Dye Donative Compound 1) | | — | — | 2.08/0.30 | |
| 202 | Yellow | (2) | (C-6) | 1.80/0.20 | — | — | Present |
| | Magenta | (2) | (C-26) | — | 2.00/0.22 | — | Invention |
| | Cyan | (2) | (C-29) | — | — | 2.20/0.30 | |
| 203 | Yellow | (13) | (C-2) | 1.91/0.21 | — | — | Present |
| | Magenta | (13) | (C-33) | — | 2.18/0.23 | — | Invention |
| | Cyan | (13) | (C-31) | — | — | 2.25/0.28 | |
| 204 | Yellow | (36) | (C-4) | 1.69/0.18 | — | — | Present |
| | Magenta | (36) | (C-32) | — | 2.05/0.20 | — | Invention |
| | Cyan | (60) | (C-37) | — | — | 2.04/0.28 | |
| 205 | Yellow | (56) | (C-16) | 1.79/0.18 | — | — | Present |
| | Magenta | (56) | (C-32) | — | 1.85/0.18 | — | Invention |
| | Cyan | (7) | (C-31) | — | — | 2.01/0.26 | |

Cover sheets were prepared as follows:

The following layers were provided on a transparent support composed of polyethylene terephthalate containing a light piping preventive dye, the support having a gelatin undercoat.

(1) A neutralizing layer containing an acrylic acid/butyl acrylate copolymer (molar ratio: 8:3) with an average molecular weight of 50,000 in an amount of 10.4 $g/m^2$ and 1,4-bis(2,3-epoxypropoxy)butane in an amount of 0.1 $g/m^2$.

(2) A neutralizing timing layer containing acetyl cellulose having a degree of oxidation of 51% in an amount of 4.3 $g/m^2$ and poly(methyl vinyl ether-comonomethylmaleid) in an amount of 0.2 $g/m^2$.

(3) A layer composed of a polymer latex prepared by emulsion polymerization of styrene/butyl acrylate/acrylic acid-N-methylolacrylamide in a weight ratio of 49.7/42.3/8 and a polymer latex prepared by emulsion polymerization of methyl methacrylate/acrylic acid/N-methylolacrylamide in a weight ratio of 93/3/4, both the polymer latexes being blended so as to be 6:4 in a ratio of solid components and applied so as to be 1.0 $g/m^2$ in a total amount of solid components.

The formulation of an alkali processing composition is as follows:

| | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium sulfite (anhydrous) | 0.2 g |
| Benzyl alcohol | 1.5 cc |
| Carboxymethyl cellulose sodium salt | 58 g |
| Carbon black | 150 g |
| Potassium hydroxide (28% aqueous solution) | 200 cc |
| Water | 680 cc |

The "vessels destructible under pressure" each are filled with 0.8 g of the processing solution having the composition described above. After the above-mentioned photographic materials were exposed to light through a gray filter from the emulsion layer side, the above-mentioned cover sheets were superposed on the photographic materials, the above-mentioned processing solutions were placed between both the materials so as to be 75 $\mu$m in thickness by use of pressure rollers to be processed.

The photographic properties were evaluated by measurements of magenta reflection densities ($D_{min}$) and the maximum densities ($D_{max}$) after an elapse of 1 day after processing.

Measurements of the densities were conducted with a Fuji system densitometer (F.S.D). Results are shown in Table 10.

Table 10 apparently show that the compounds of the present invention afford minimum densities ($D_{min}$) as low as those of conventional dye image formation compounds and sufficiently high image densities ($D_{max}$) to be recognized as excellent image formation compounds.

EXAMPLE 3

The following photosensitive material 301 was prepared as a color diffusion transfer material. Photosensitive Material 301

A photosensitive sheets was prepared by providing the following layers on a transparent support composed of polyethylene terephthalate.

Backing Layer: (a) A light-shielding layer containing carbon black (4.0 g/m$^2$) and gelatin (2.0 g/m$^2$).

Emulsion Layer Side:

(1) A layer containing the red sensitive internal latent image type direct positive emulsion (0.6 g/m$^2$ in terms of silver), gelatin (2.0 g/m$^2$), a nucleating agent shown below (0.015 mg/m$^2$), 2-sulfo-5-n-pentadecylhydroquinone sodium salt (0.06 g/m$^2$), a cyan dye donative compound shown below (0.44 g/m$^2$), tricyclohexyl phosphate (0.14 g/m$^2$), and 2,5-di-t-pentadecylhydroquinone (0.008 g/m$^2$).

(2) A layer containing 2,5-di-t-pentadecylhydroquinone (0.43 g/m$^2$), trihexyl phosphate (0.1 g/m$^2$) and gelatin (0.4 g/M$^2$).

(3) A layer containing the green sensitive internal latent image type direct positive silver bromide emulsion (0.43 g/m$^2$ in terms of silver), gelatin (1.4 g/m$^2$), the same nucleating agent as used for layer (1) (0.013 mg/m $^2$), 2-sulfo-5-n-pentadecylhydroquinone sodium salt (0.07 g/m$^2$), a magenta dye donative compound shown below (0.3 g/m$^2$), tricyclohexyl phosphate (0.12 g/m$^2$), and 2,5-di-t-pentadecylhydroquinone (0.009 g/M$^2$).

Magenta Dye Donative Compound (2)

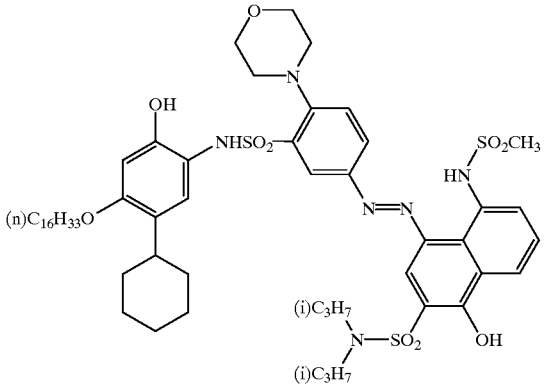

(4) The same layer as that described in (2).

(5) A layer containing the blue sensitive internal latent image type direct positive silver bromide emulsion (0.6 g/m$^2$ in terms of silver), gelatin (1.8 g/m$^2$) ,the same nucleating Cyan Dye Donative Compound (2)

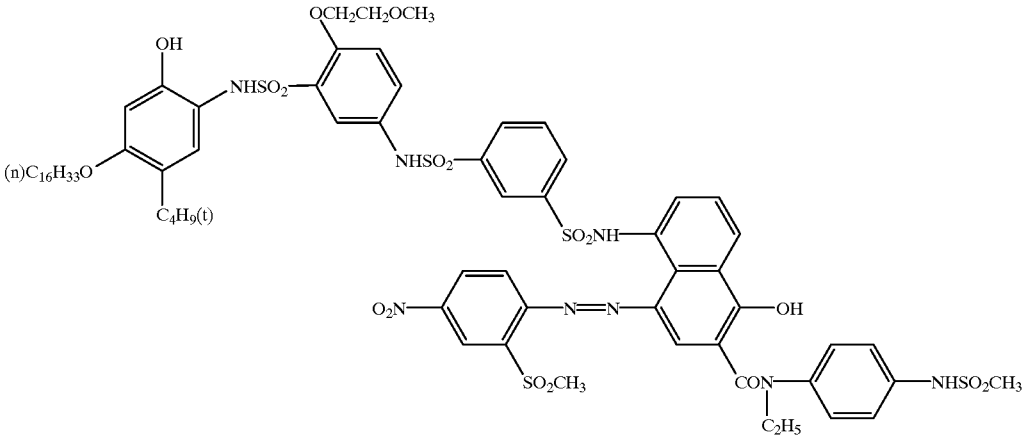

Nucleating Agent

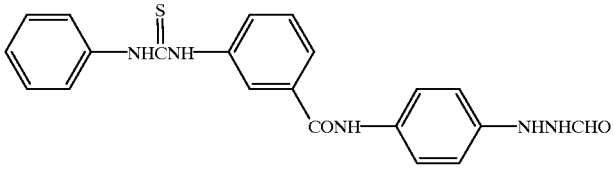

agent as that used for layer (1) (0.019 mg/m$^2$), 2-sulfo-5-n-pentadecylhydroquinone sodium salt (0.05 g/m$^2$), a yellow dye donative compound shown below (0.53 g/m$^2$), tricyclohexyl phosphate (0.21 g/m$^2$), and 2,5-di-t-pentadecylhydroquinone (0.014 g/m$^2$).

Yellow Dye Donative Compound (2)

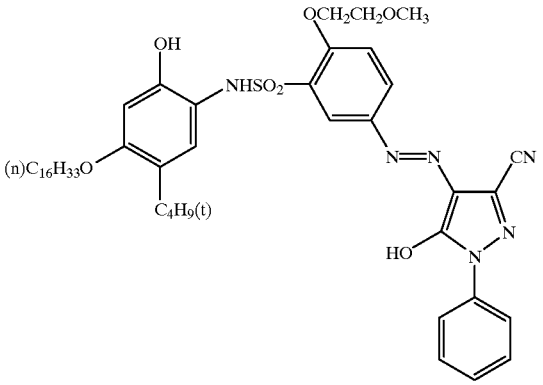

(6) A layer containing gelatin (1.0 g/m$^2$)

Subsequently, a dye fixing material having a structure shown in Table 11 was prepared.

TABLE 11

Constitution of Image Receiving Element

| Layer No. | Name of Layer | Additives | Coating Amounts (g/m$^2$) |
|---|---|---|---|
| F6 | Protective | Gelatin | 0.6 |
| Layer | Layer | Formaldehyde | 0.0036 |
| F5 | Mordant | Gelatin | 3.0 |
| Layer | Layer | Formaldehyde | 0.015 |
| | | Mordant (A) | 1.7 |
| | | Coating Aid | 0.005 |
| F4 | Timing | Polymer Latex (1) | 0.96 |
| Layer | Layer (1) | Polymer Latex (2) | 0.64 |
| F3 | Interlayer | Poly(2-hydroxyethyl | 0.4 |
| Layer | | Methacrylate) | |
| F2 | Timing | Cellulose Acetate (Degree | 4.27 |
| Layer | Layer (2) | of Oxidation: 51%) | |
| | | Styrene/Maleic Anhydride Copolymer (1:1 in molar ratio) (average molecular weight: 10,000) | 0.23 |
| F1 | Interlayer | Acrylic acid/Butyl Acrylate Copolymer (8:2 in molar ratio) (average molecular weight: 50,000) | 22 |
| A Paper Support (150 μm, Polyethylene having a thickness of 30 μm was laminated to both the sides of the support) | | | |
| B1 | Light- | Gelatin | 2.0 |
| Layer | Shielding | Carbon Black | 4.0 |
| | Layer | | |
| B2 | White | Gelatin | 1.0 |
| Layer | Layer | Titanium Oxide | 8.0 |
| B3 | Protective | Gelatin | 0.6 |
| Layer | Layer | | |

Coating Aid

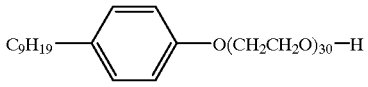

TABLE 11-continued

Constitution of Image Receiving Element

| Layer No. | Name of Layer | Additives | Coating Amounts (g/m$^2$) |
|---|---|---|---|

Mordant (A)

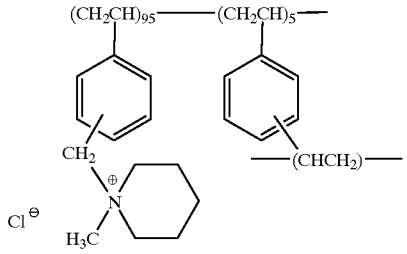

Polymer Latex (1): prepared by emulsion polymerization of styrene, butyl acrylate, acrylic acid, and N-methylolacrylamide in a weight ratio of 49.7:42.3:4:4.

Polymer Latex (2): prepared by emulsion polymerization of methyl methacrylate, acrylic acid and N-methylolacrylamide in a weight ratio of 93:3:4.

The destructible vessels were filled with 0.8 g of a processing solution having the following composition:

| | |
|---|---|
| 1-p-Tolyl-4-hydroxymethyl-4-methyl-3-pyrazolidone | 10.0 g |
| 1-Phenyl-4-hydroxymethyl-4-methyl-3-pyrazolidone | 4.0 g |
| Potassium sulfite (anhydrous) | 4.0 g |
| Hydroxyethyl cellulose | 40.0 g |
| Potassium hydroxide | 64.0 g |
| Benzyl alcohol | 2.0 g |
| With water | to 1 kg in total weight |

Photosensitive materials 302 to 305 were prepared in a similar manner to photosensitive material 301 except that the cyan, magenta and yellow dye donative compounds used for photosensitive material 301 were replaced by those described in Table 12 in equimolar quantities.

These photosensitive materials 301 to 305 were exposed to light through color charts in which wedges of cyan, magenta, yellow, and gray, each having densities to continuously change, are recorded, and superposed on dye fixing materials. The above-mentioned processing solution was spread between both the sheets so as to be 60 μm in thickness with the aid of pressure rollers. Processing was performed at 25° C. After 90 seconds the dye fixing materials were separated from the photosensitive materials, allowed to stand for drying to determine relative sensitivity and densities.

Reflection densities were measured with an X Light 404 densitometer manufactured by X Light Co., Ltd. to estimate the maximum densities ($D_{max}$) and the minimum densities ($D_{min}$). Further, photosensitive materials 301 to 305 were allowed to stand under the conditions of 45° C.—80% RH to estimate the sensitivity. Results are shown in Table 12.

TABLE 12

| Photo-sensitive Material No. | Color forming Layer | Color Developing Agent No. | Coupler No. | Yellow ($D_{max}/D_{min}$) | Magenta ($D_{max}/D_{min}$) | Cyan ($D_{max}/D_{min}$) | Relative Sensitivity* | Relative Sensitivity* after Forced Aging | Notes |
|---|---|---|---|---|---|---|---|---|---|
| 301 | Yellow | (Yellow Dye Donative Compound 2) | | 1.95/0.19 | — | — | 100 | 95 | Comparative |
| | Magenta | (Magenta Dye Donative Compound 2) | | — | 2.28/0.22 | — | 100 | 84 | Example |
| | Cyan | (Cyan Dye Donative Compound 2) | | — | — | 2.36/0.30 | 100 | 70 | |
| 302 | Yellow | (2) | (C-6) | 2.02/0.19 | — | — | 170 | 167 | Present |
| | Magenta | (2) | (C-26) | — | 2.28/0.21 | — | 145 | 146 | Invention |
| | Cyan | (2) | (C-29) | — | — | 2.39/0.29 | 188 | 185 | |
| 303 | Yellow | (13) | (C-2) | 2.15/0.19 | — | — | 160 | 160 | Present |
| | Magenta | (13) | (C-33) | — | 2.41/0.23 | — | 138 | 137 | Invention |
| | Cyan | (13) | (C-31) | — | — | 2.44/0.28 | 179 | 176 | |
| 304 | Yellow | (36) | (C-4) | 1.90/0.15 | — | — | 155 | 152 | Present |
| | Magenta | (36) | (C-32) | — | 2.14/0.20 | — | 135 | 135 | Invention |
| | Cyan | (60) | (C-37) | — | — | 2.25/0.29 | 178 | 175 | |
| 305 | Yellow | (56) | (C-16) | 1.89/0.16 | — | — | 159 | 158 | Present |
| | Magenta | (56) | (C-32) | — | 2.17/0.20 | — | 140 | 142 | Invention |
| | Cyan | (7) | (C-31) | — | — | 2.35/0.27 | 181 | 177 | |

*Relative sensitivity based on the sensitivity of photosensitive material 301 prior to forced aging, which is assumed to be 100.

Table 12 reveals that photosensitive elements 302 to 305 of the present invention afford high sensitivity and sufficient image densities, compared to photosensitive element 301 in which preformed dyes are used, and that variations in sensitivity before and after the forced test also are markedly improved. In the photosensitive elements of the present invention, sufficient maximum densities ($D_{max}$) and sufficiently low minimum densities ($D_{min}$) can be attained, and further, the photosensitive elements of the present invention are also found to exhibit excellent resistance to humidity and heat.

Use of the color developing agents of the present invention makes it possible to very efficiently form diffusible dyes from colorless compounds (color developing agents and couplers), and thus, the objects of the present invention have been attained.

What is claimed is:

1. A color diffusion transfer silver halide photographic material comprising a support having provided thereon at least one hydrophilic colloid layer containing at least one color developing agent represented by the following formula (I):

(I)

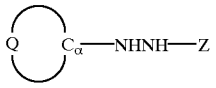

wherein $C_\alpha$ represents a carbon atom; Z is a carbamoyl group, and at least one hydrogen atom is linked to the nitrogen atom of the carbamoyl group; and Q represents an atomic group for forming an unsaturated heterocyclic ring or a benzene ring together with $C_\alpha$; said benzene ring having a substituent group(s); and the sum of the Hammett substituent constants (δ values) of the substituent group(s) is not less than 0.8, with the proviso that when a substituent group exists at the 2- or 4-position to $C_\alpha$, the $\delta_p$ value is applied thereto, and when a substituent group exists at the 3-position to $C_\alpha$, the $\delta_m$ value is applied thereto; and at least one layer containing at least one color coupler that forms a diffusible dye upon reaction with the at least one color developing agent.

2. A color diffusion transfer silver halide photographic material of claim 1 wherein comprising a support having a provided thereon at least one hydrophilic colloid layer containing at least one color developing agent represented by the following formula (I):

(I)

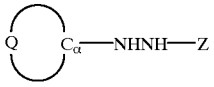

wherein $C_\alpha$ represents a carbon atom; Z represents a carbamoyl group, an acyl group, an alkoxycarbonyl group, or an aryloxycarbonyl group; and Q represents an heterocyclic ring together with $C_\alpha$.

3. The color diffusion transfer silver halide photographic material of claim 1, wherein Z is a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-tert-pentylphenoxy)-propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxphenylcarbamoyl group, a benzyloxycarbamoyl group, or a 2,5-dioxo-1-pyrrolidinylcarbamoyl group.

4. The color diffusion transfer silver halide photographic material of claim 1, wherein Q represents an atomic group forming said benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxzole ring, an isothiazole ring, an isoxazole ring, or a thiophene ring together with $C_\alpha$.

5. The color diffusion transfer silver halide photographic material of claim 2, wherein Z is a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-tert-pentylphenoxy)-propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxphenylcarbamoyl group, a benzyloxycarbamoyl group, or a 2,5-dioxo-1-pyrrolidinylcarbamoyl group.

6. The color diffusion transfer silver halide photographic material of claim 2, wherein Q represents an atomic group forming a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxzole ring, an isothiazole ring, an isoxazole ring, or a thiophene ring together with $C_\alpha$.

7. A process for forming an image, which comprises: imagewise exposure to light a color diffusion transfer silver halide photographic material, wherein the color diffusion transfer silver halide photographic material comprises a support having provided thereon at least one hydrophilic colloid layer containing at least one color developing agent represented by the following formula (I):

(I)

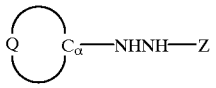

wherein $C_\alpha$ represents a carbon atom; Z is a carbamoyl group, and at least one hydrogen atom is linked to the nitrogen atom of the carbamoyl group; and Q represents an unsaturated heterocyclic ring or a benzene ring together with $C_\alpha$; said benzene ring having a substituent group(s); and the sum of the Hammett substituent constants (δ values) of the substituent group(s) is not less than 0.8, with the proviso that when a substituent group exists at the 2- or 4-position to $C_\alpha$, the $\delta_p$ value is applied thereto, and when a substituent group exists at the 3-position to $C_\alpha$, the $\delta_m$ value is applied thereto; and at least one layer containing at least one color coupler that forms a diffusible dye upon reaction with the at least one color developing agent;

developing a color diffusion transfer silver halide photographic material (i) by heat development, (ii) with the aid of an alkali which is generated from an insoluble metallic salt and a complexing agent for the insoluble metallic salt, or (iii) by spreading an alkaline processing solution; and transferring the diffusible dye to a dye fixing layer to form an image.

8. The process for forming an image of claim 7, wherein Z is a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-tert-pentylphenoxy)-propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxphenylcarbamoyl group, a benzyloxycarbamoyl group, or a 2,5-dioxo-1-pyrrolidinylcarbamoyl group.

9. The process for forming an image of claim 7, wherein Q represents an atomic group forming a heterocyclic ring together with $C_\alpha$.

10. The process for forming an image of claim 7, wherein Q represents an atomic group forming said benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxzole ring, an isothiazole ring, an isoxazole ring, or a thiophene ring together with $C_\alpha$.

* * * * *